US007232275B2

(12) United States Patent
Skalka

(10) Patent No.: US 7,232,275 B2
(45) Date of Patent: Jun. 19, 2007

(54) BOLLARD AND ACCESSORIES FOR USE THEREWITH

(75) Inventor: Gerald P. Skalka, Potomac, MD (US)

(73) Assignee: Secure Site Design, LLC, Dunkirk, MD (US)

( * ) Notice: Subject to any disclaimer, the term of this patent is extended or adjusted under 35 U.S.C. 154(b) by 0 days.

(21) Appl. No.: 10/252,538

(22) Filed: Sep. 24, 2002

(65) Prior Publication Data

US 2004/0035988 A1 Feb. 26, 2004

Related U.S. Application Data

(63) Continuation-in-part of application No. 29/165,862, filed on Aug. 20, 2002, now Pat. No. Des. 474,846.

(51) Int. Cl.
*E01F 9/011* (2006.01)

(52) U.S. Cl. ..... 404/9; 116/63 R; 248/694

(58) Field of Classification Search ..... 248/316.8, 248/466, 469, 694, 188.1; D25/126; 52/292, 52/737.2, 653.2; 446/85, 107, 108, 109, 446/118; 404/6, 9, 10, 11
See application file for complete search history.

(56) References Cited

U.S. PATENT DOCUMENTS

| | | | | |
|---|---|---|---|---|
| 2,001,646 | A * | 5/1935 | Abitsch | 248/41 |
| 2,441,309 | A | 5/1948 | Cook | |
| 3,081,054 | A | 3/1963 | Westervelt | |
| 3,521,596 | A | 7/1970 | Schlein | |
| 3,555,550 | A | 1/1971 | Walters | |
| 3,800,735 | A | 4/1974 | Simpson | |
| 3,875,720 | A | 4/1975 | Russell | |
| 4,036,293 | A * | 7/1977 | Tank et al. | 165/134.1 |
| 4,103,853 | A * | 8/1978 | Bannan | 248/219.1 |
| 4,187,785 | A * | 2/1980 | Juh | 108/36 |
| 4,197,807 | A | 4/1980 | Campbell | |
| 4,686,144 | A * | 8/1987 | Hupfer et al. | 428/421 |
| 4,858,382 | A | 8/1989 | Ellgass | 49/35 |

(Continued)

FOREIGN PATENT DOCUMENTS

| | | |
|---|---|---|
| DE | 297 18 936 | 12/1997 |

(Continued)

*Primary Examiner*—Anita King
*Assistant Examiner*—Steven Marsh
(74) *Attorney, Agent, or Firm*—Jacobson Holman PLLC

(57) ABSTRACT

A bollard comprising a series of at least two nested, inverted U-shaped forms of decreasing height set around a common vertical axis. Each U-shaped form has an upper transverse portion and two parallel, vertical legs extending from the upper transverse portion. The bollard further comprises at least one center joining plate located below the upper transverse portions of the forms and being substantially perpendicular to the forms, for joining the U-shaped forms together as a unit, the forms being fastened to the at least one center joining plate. The bollard can also include an anchor plate attached to the forms at or adjacent their bottom, for anchoring the forms to a support surface. The bollard can be used in a system comprising at least one other bollard and/or at least one site amenity (for example, seating, lighting, signage, a shelter, a trash can receptacle, and an ash urn), wherein the at least one site amenity is associated with the at least one other bollard, for example by being attached thereto.

21 Claims, 28 Drawing Sheets

U.S. PATENT DOCUMENTS

| | | | | |
|---|---|---|---|---|
| D319,159 | S | * | 8/1991 | Silbersky et al. ..... D6/498 |
| D324,920 | S | | 3/1992 | Miller et al. ..... D25/126 |
| 5,149,901 | A | * | 9/1992 | Boor et al. ..... 84/327 |
| 5,176,830 | A | * | 1/1993 | Wiggins ..... 210/477 |
| 5,305,705 | A | | 4/1994 | Gagliano |
| D361,229 | S | | 8/1995 | Laske ..... D6/486 |
| 5,438,937 | A | * | 8/1995 | Ball et al. ..... 108/64 |
| 5,566,638 | A | | 10/1996 | Rokosny |
| 5,788,405 | A | | 8/1998 | Beard |
| D406,664 | S | | 3/1999 | Müller ..... D25/126 |
| 5,960,601 | A | | 10/1999 | Offutt ..... 52/292 |
| D447,250 | S | | 8/2001 | Dionne et al. ..... D25/126 |
| 6,341,877 | B1 | | 1/2002 | Chong |
| 6,375,385 | B1 | | 4/2002 | Kennedy |
| 6,378,821 | B1 | * | 4/2002 | McKelvy et al. ..... 248/218.4 |

FOREIGN PATENT DOCUMENTS

| | | |
|---|---|---|
| DE | 297 19 091 U | 12/1997 |
| GB | 2 123 065 A | 1/1984 |

* cited by examiner

FIG. 7A
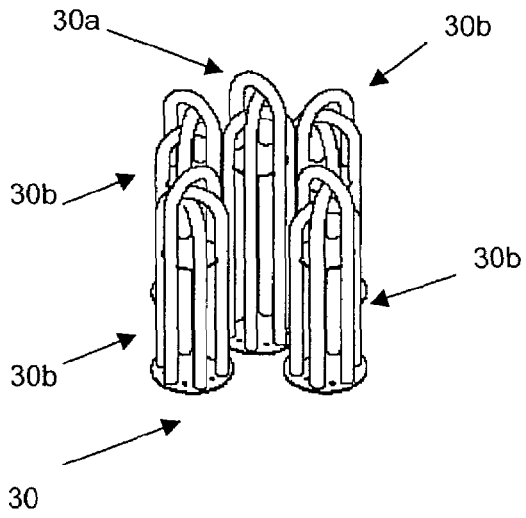
FIG. 7B
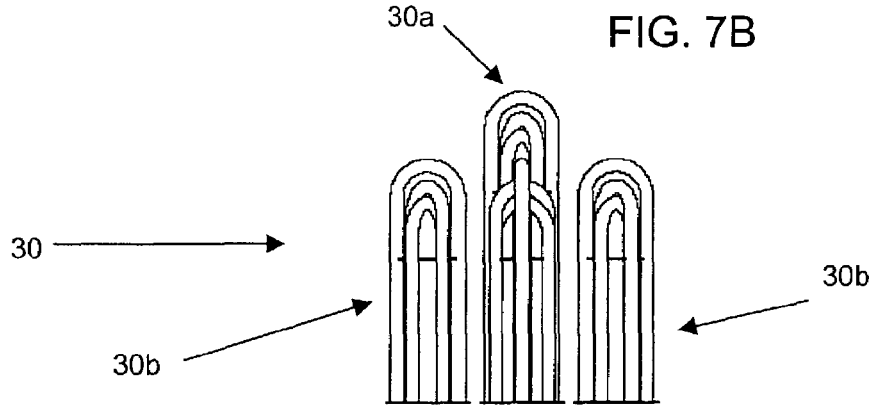
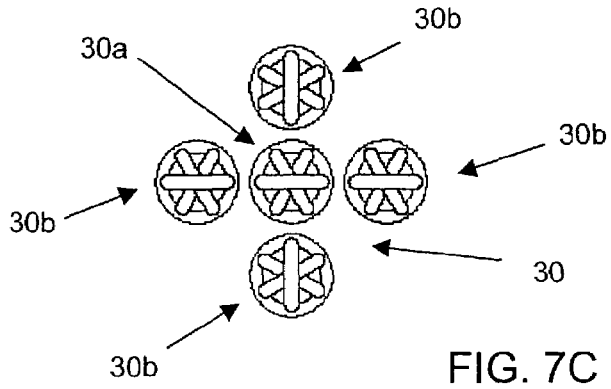
FIG. 7C

FIG. 9A
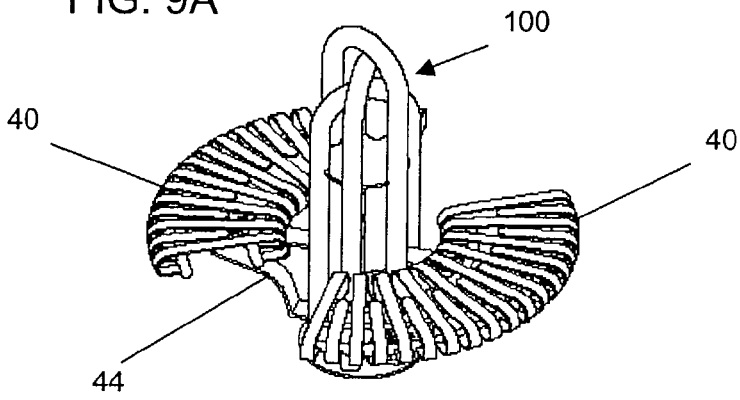
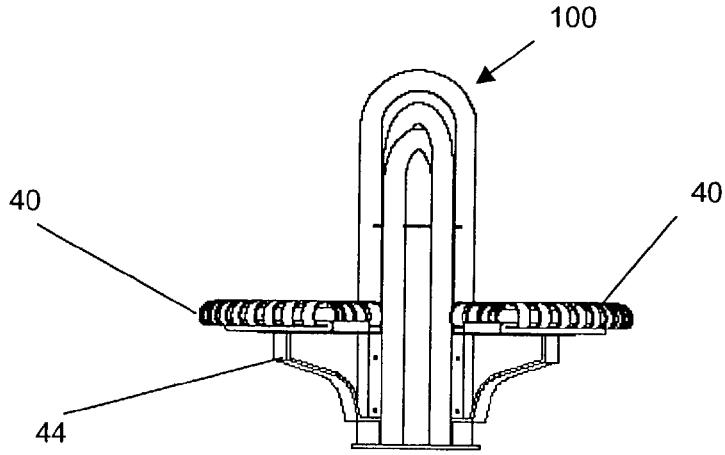
FIG. 9B
FIG. 9C
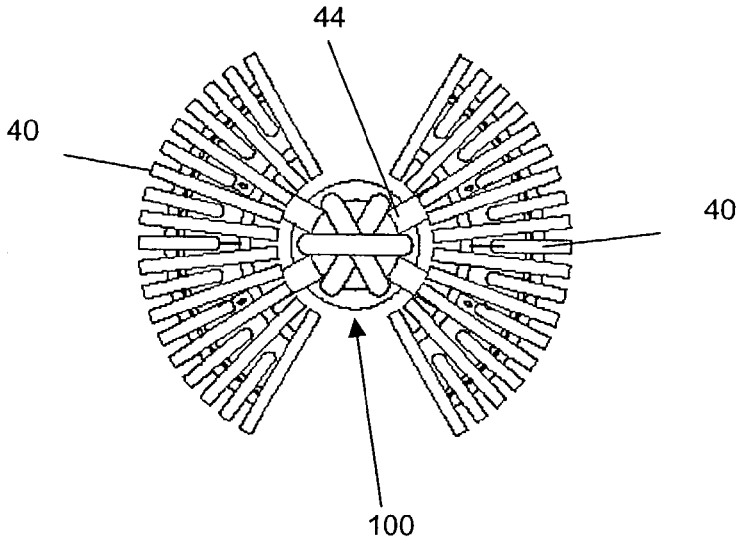

FIG. 13A
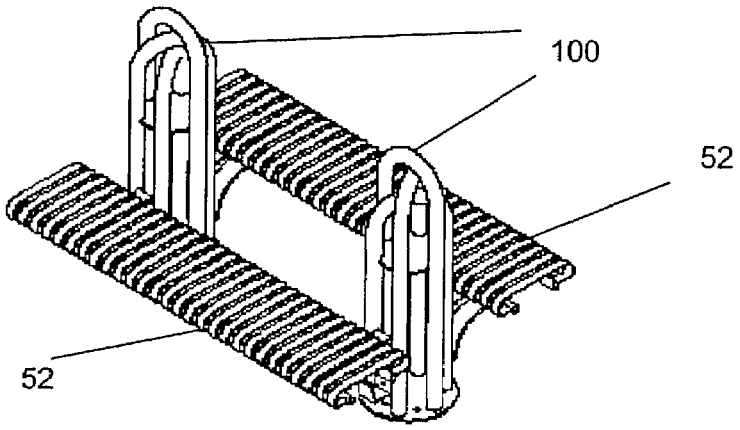
FIG. 13B
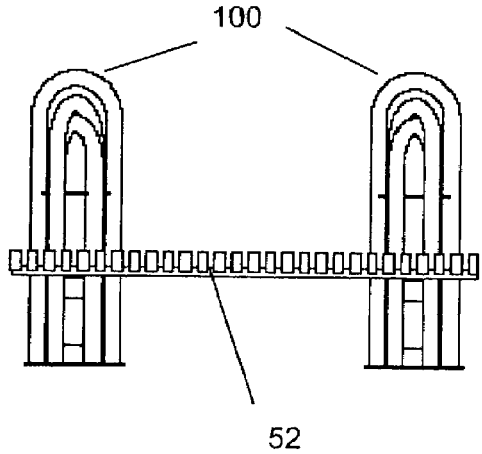
FIG. 13C
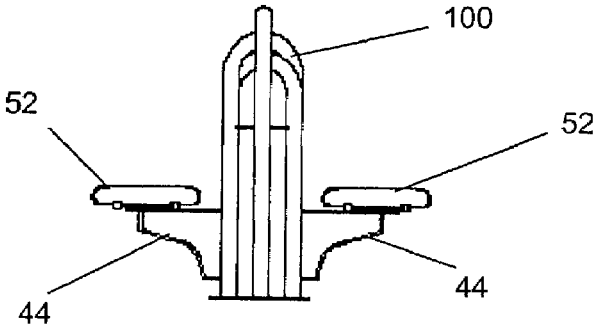
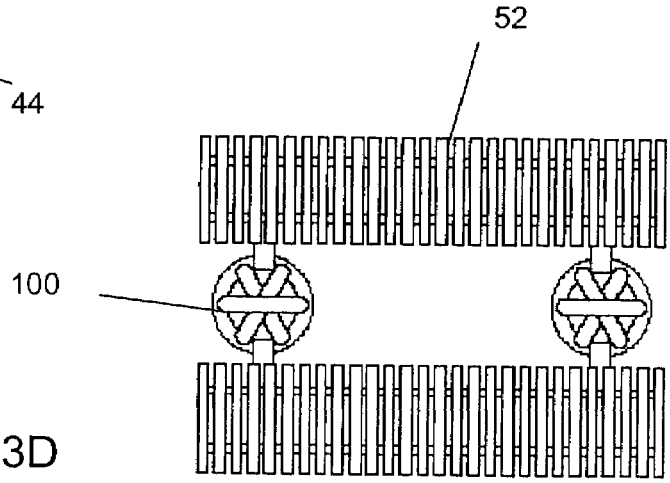
FIG. 13D

FIG. 16A
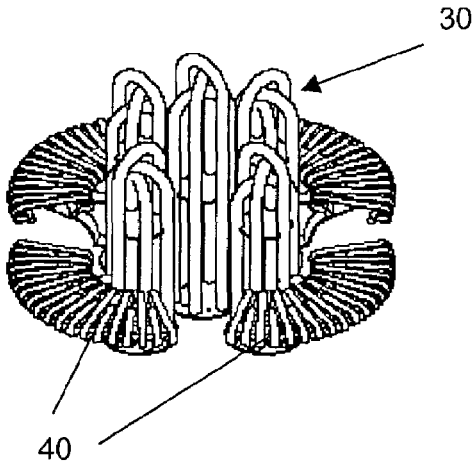
FIG. 16B
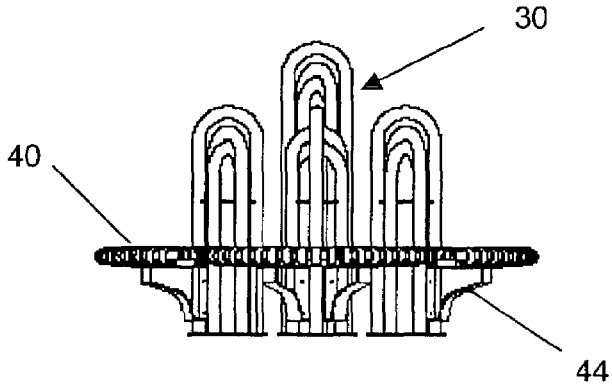
FIG. 16C
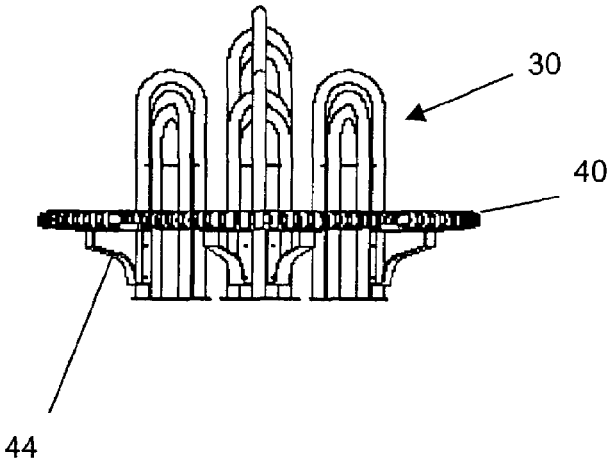
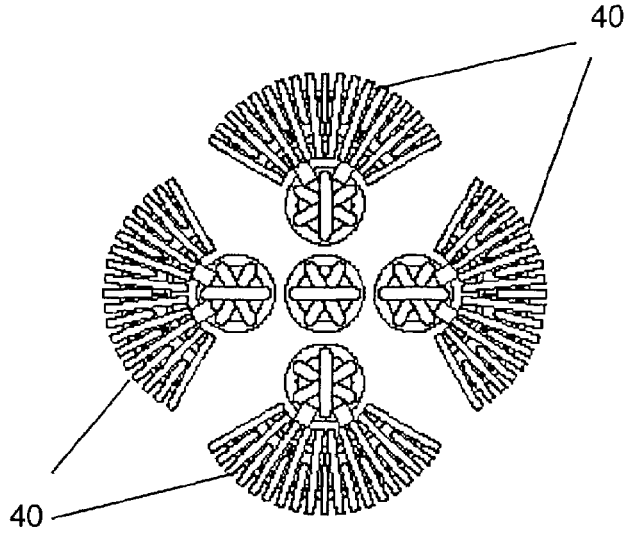
FIG. 16D

FIG. 18A
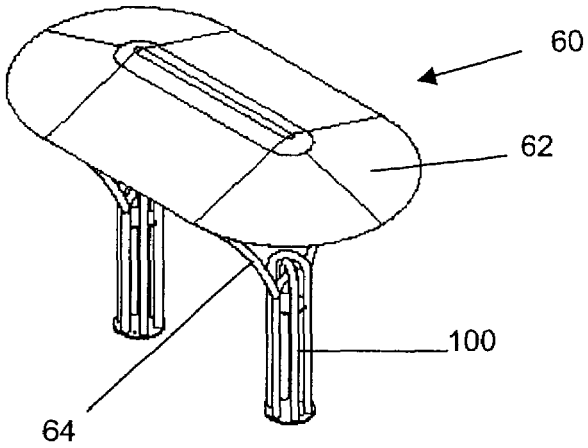
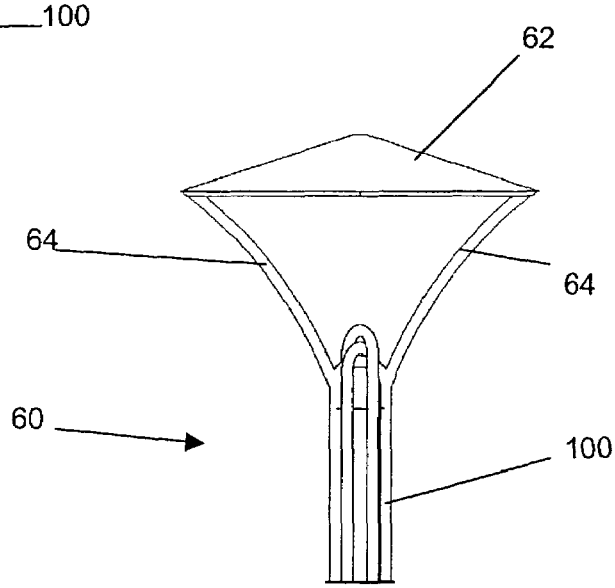
FIG. 18C
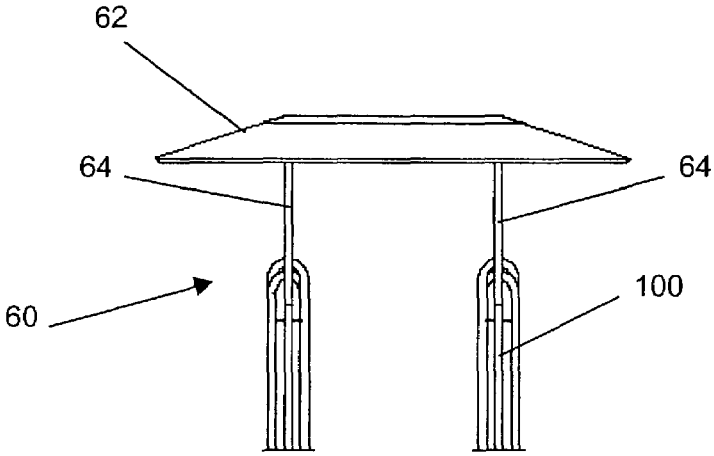
FIG. 18B

FIG. 19A
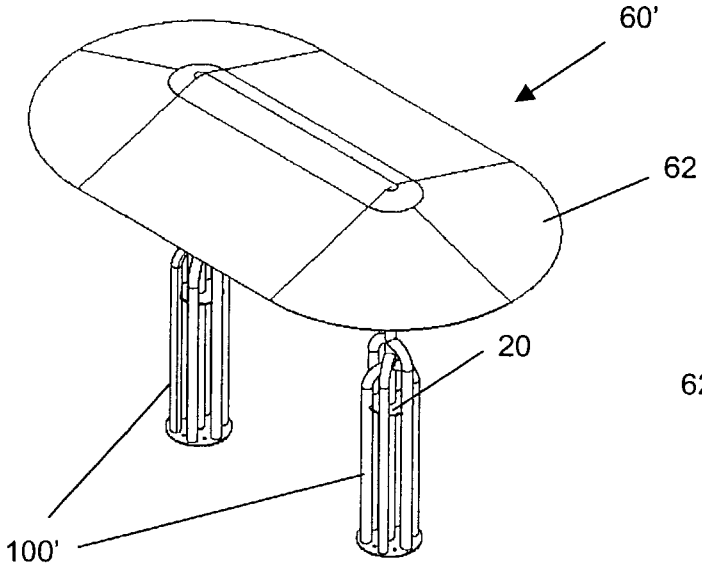
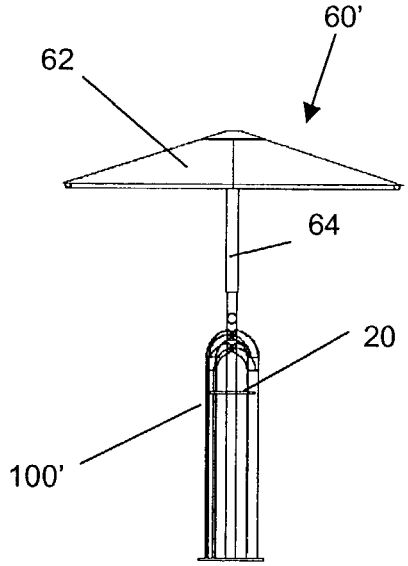
FIG. 19C
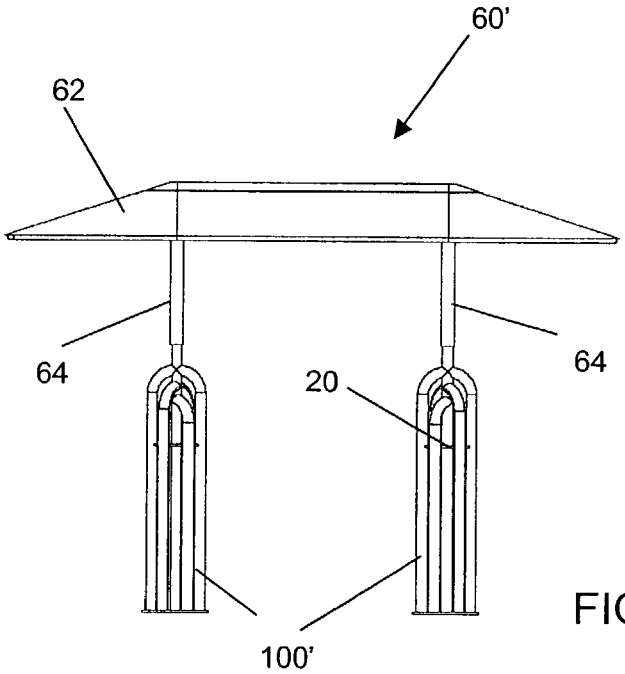
FIG. 19B

FIG. 20A
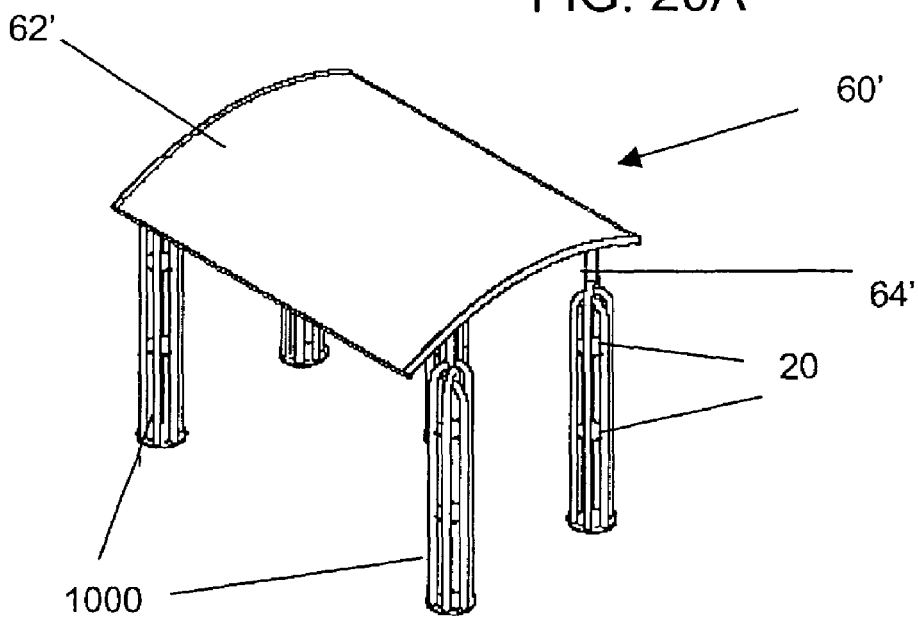
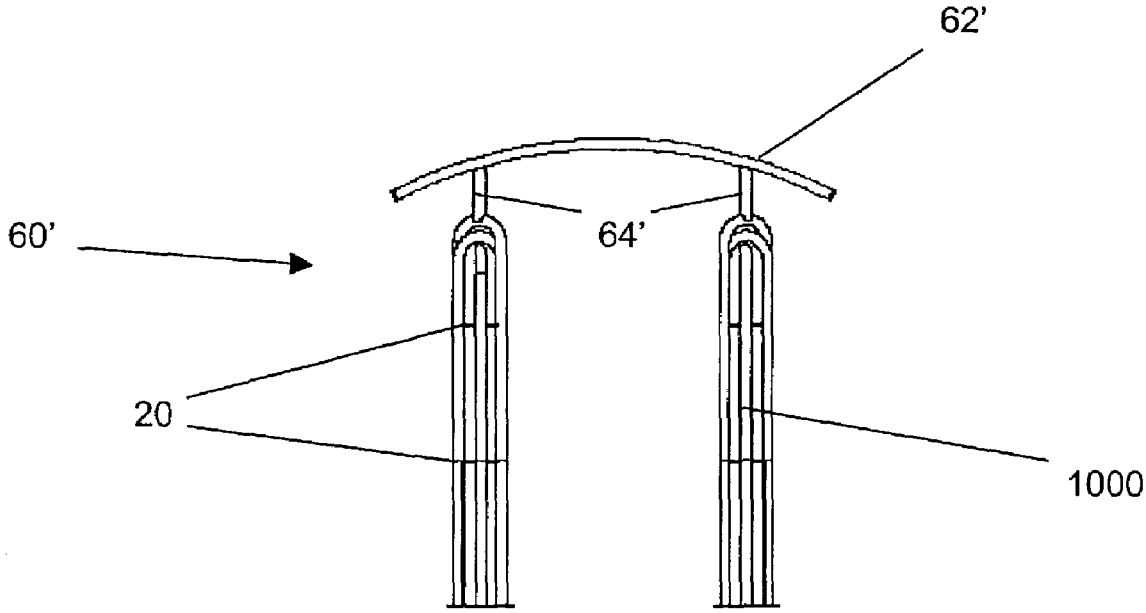
FIG. 20B

FIG. 27A
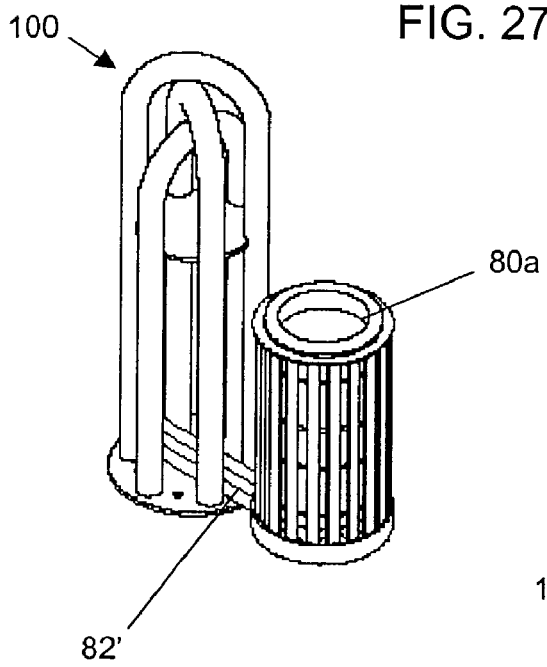
FIG. 27B
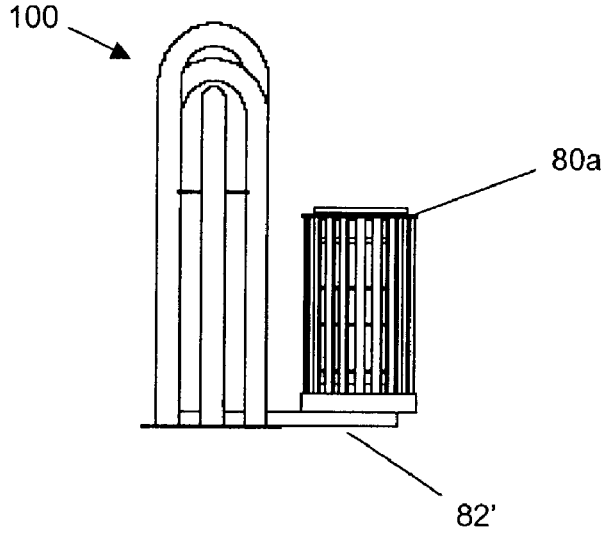
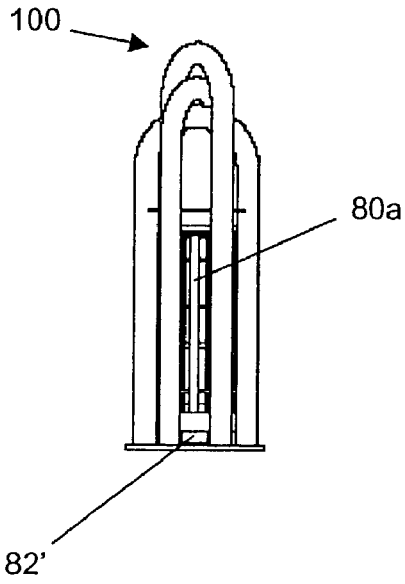
FIG. 27C

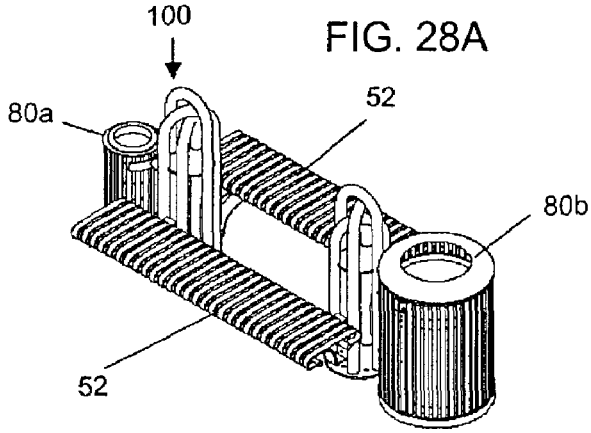
FIG. 28A
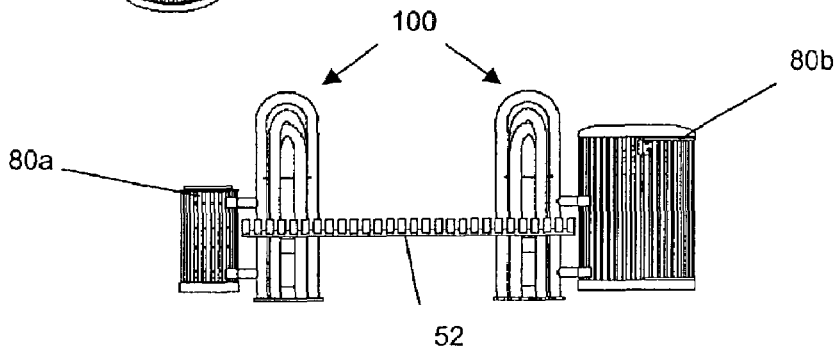
FIG. 28B
FIG. 28E
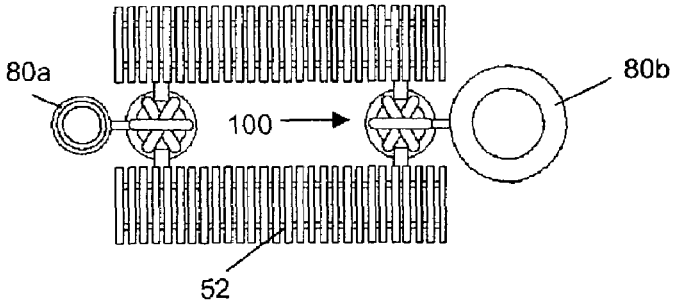
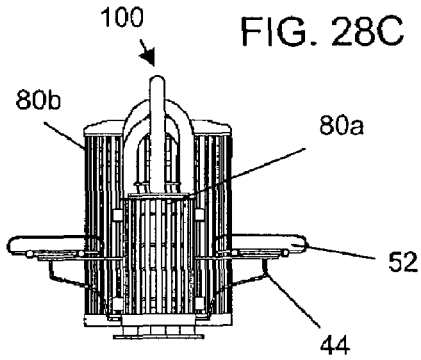
FIG. 28C
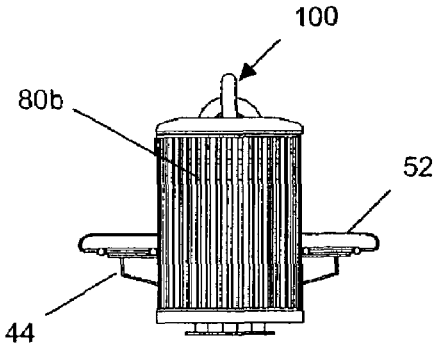
FIG. 28D FIG. 29A
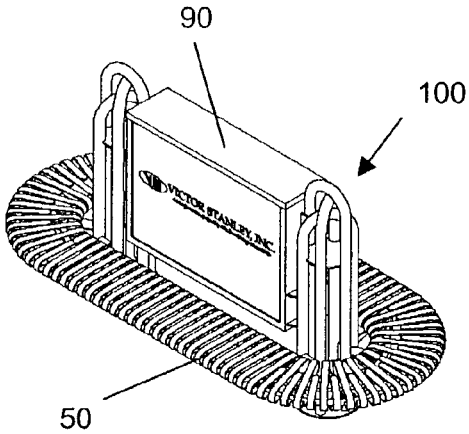
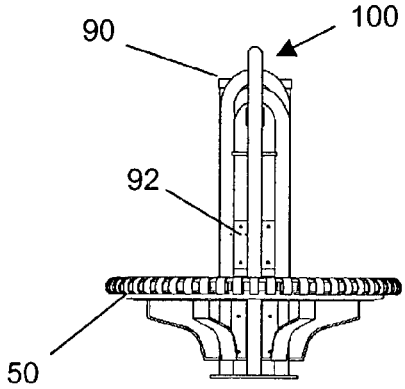
FIG. 29C
FIG. 29B
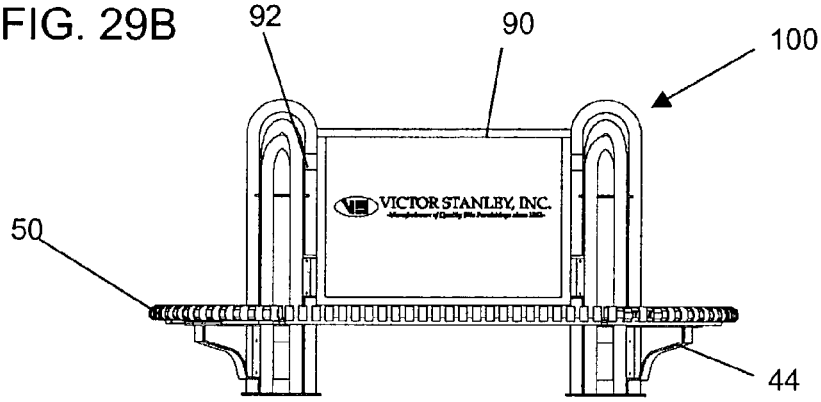
FIG. 29D
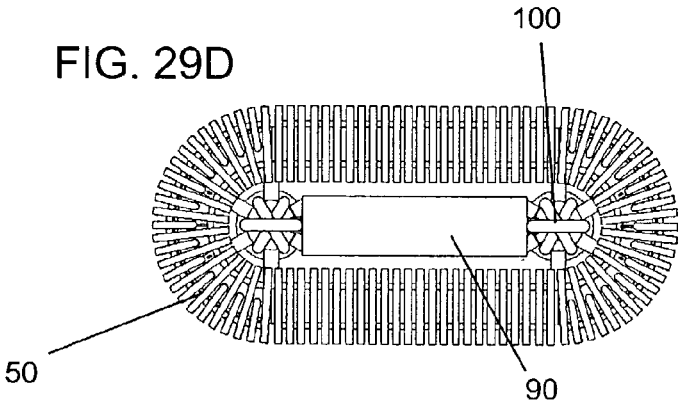

FIG. 30A
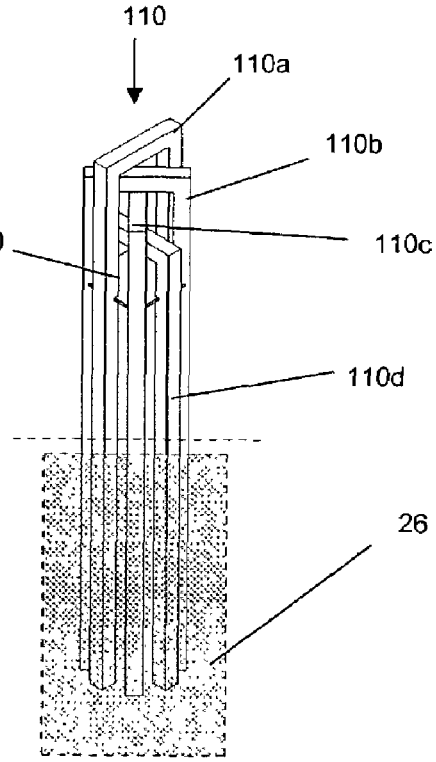
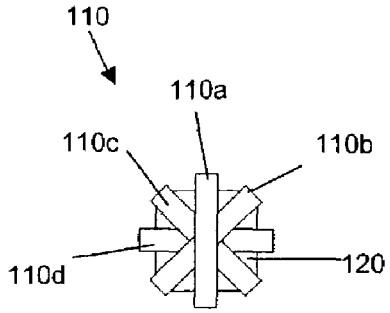
FIG. 30D
FIG. 30B
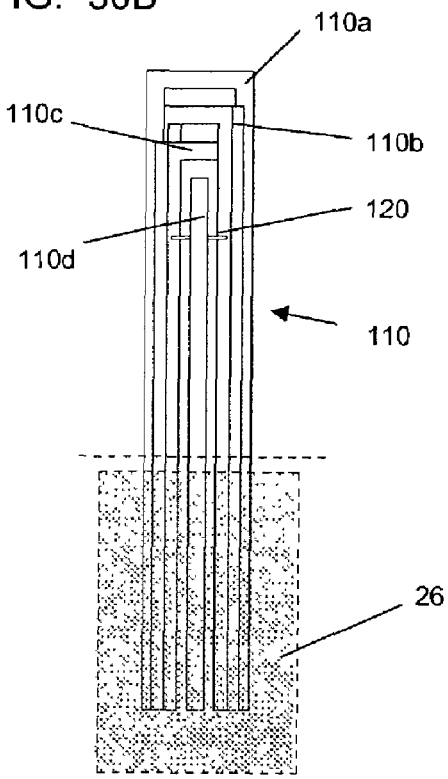
FIG. 30C
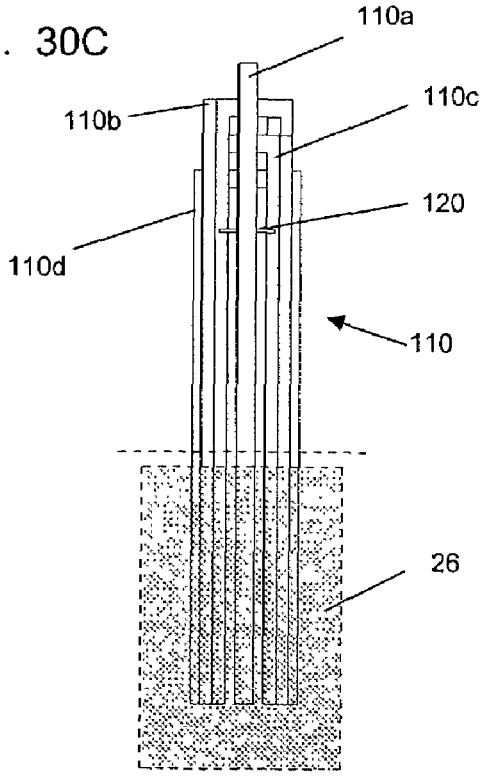

BOLLARD AND ACCESSORIES FOR USE THEREWITH

CROSS-REFERENCE TO RELATED APPLICATIONS

The present patent application is a continuation-in-part of application Ser. No. 29/165,862, filed Aug. 20, 2002 now U.S. Pat. No. D, 474,846, which is incorporated herein by reference in its entirety.

BACKGROUND OF THE INVENTION

1. Field of the Invention

The present invention relates to public-space fixtures. More specifically, the invention relates to a universal public-space fixture that is adaptable to use as a bollard, usable alone or in a system of bollards, and/or with accessories including but not limited to seating, shelters, signage, lamps, ash-urns, and litter receptacles.

2. Related Art

As a result of the newly defined threat to people occupying ordinary public places in their daily activities, it has now become apparent that conventional public-space fixtures (for example, benches and chairs, litter receptacles, lamps, etc.) must evolve into devices that enhance security, provide conventional function (for example, seating, litter control, lighting, etc.) and allow for the subtle directing of pedestrian traffic. They also must allow for a pleasing, cohesive design system that integrates multiple functions.

Such devices must also eventually meet standards now being written to accommodate the threats posed by vehicular traffic in or near pedestrian spaces. They must likewise provide reasonable barrier protection to entrances, plazas, city streets, areas of congestion, etc. They must simultaneously be cost effective and flexible in design to provide multiple functions. Their design must be easily modified to provide increased strength and protection without inordinately higher cost or significantly larger size, as larger size can easily overwhelm public spaces, making the function of providing protection a deterrent to the successful use of public spaces. Scale is important given the limited space available, the footprint of such devices, and the necessity for the safe movement of pedestrians.

In addition, as a standard requirement, public-space fixtures must be sufficiently attractive to provide permanent and otherwise successful replacement for the concrete slabs and "Jersey Walls" that have been placed temporarily to provide safety.

The same design fixture must be adaptable to seating, shelters, bollards, signage, lamps, and the holding of such elements as ash-urns and litter receptacles. In all such configurations, the fixture must be easily installable as an in-ground or above-ground (bolted-down) structure. The fixture must be configurable to accommodate the evolving standards for the spacing of bollards and barriers, while meeting conventional requirements for accessibility for all people.

These diverse and constantly changing criteria make it necessary to design the elements of public fixtures as part of a set of safety, protective, informational, and convenience requirements.

It is to the solution of these and other problems that the present invention is directed.

SUMMARY OF THE INVENTION

It is accordingly a primary object of the present invention to provide a universal public-space fixture that is cost effective and flexible in design to provide multiple functions.

It is another object of the present invention to provide a universal public-space fixture that can be easily modified to provide increased strength and protection without inordinately higher cost or significantly larger size.

It is still another object of the present invention to provide a universal public-space fixture that is adaptable to seating, shelters, bollards, signage, lighting, and the holding of such elements as ash-urns and litter receptacles.

It is still another object of the present invention to provide a universal public-space fixture that is adaptable to use as a bollard, usable alone or in a grouping of other bollards, or with accessories including but not limited to seating, shelters, signage, lighting, ash-urns, and litter receptacles.

These and other objects of the invention are achieved by the provision of a universal public-space fixture comprising a series of at least two nested, inverted substantially U-shaped forms of decreasing height set around a common vertical axis. "Nested," as used herein, refers to a set of objects of graduated size that can be stacked together, each fitting within the one immediately larger. Each substantially U-shaped form has an upper transverse portion and two parallel, vertical legs extending from the upper transverse portion. The upper transverse portion can be curved, either symmetrically or asymmetrically, with a smooth transition to the legs, or it can be linear and joined to the legs at a miter joint.

In one aspect of the invention, the fixture further comprises means for joining the substantially U-shaped forms together as a unit, for example, at least one center joining plate located below the upper transverse portions of the forms, the forms being fastened to the at least one center joining plate. The at least one center joining plate is substantially perpendicular to the forms, and can comprise a disc having notches at the perimeter thereof for engaging the substantially U-shaped forms, or a spider having radiating arms that engage the substantially U-shaped forms.

In another aspect of the invention, the forms are substantially vertical and the at least one center joining plate is substantially horizontal.

In another aspect of the invention, the fixture further comprises means for anchoring the forms to a support surface, for example, an anchor plate attached to the forms at or adjacent their bottom.

In still another aspect of the invention, the fixture can be used in a public-space system comprising at least one other universal public-space fixture and/or at least one site amenity (for example, seating, lighting, signage, a shelter, a trash can receptacle, and an ash urn). Where the public-space system includes at least one site amenity, the site amenity is associated with the universal public-space fixture, for example by being attached thereto.

Other objects, features and advantages of the present invention will, be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIGS. 7A, 7B, and 7C are respectively perspective, side elevational, and views of a grouping of universal public-space fixtures in accordance with the present invention.

FIGS. 9A, 9B, and 9C are respectively perspective, side elevational, and top plan views of a second embodiment of a single universal public-space fixture having seating associated therewith.

FIGS. 10A, 10B, and 10C are respectively perspective, side elevational, and top plan views of a third embodiment of a single universal public-space fixture having seating associated therewith.

FIGS. 13A, 13B, 13C, and 13D are respectively perspective, front elevational, side elevational, and top plan views of a third embodiment of a grouping of universal public-space fixtures having seating associated therewith.

FIGS. 16A, 16B, 16C, and 16D are respectively perspective, front elevational, side elevational, and top plan views of a sixth embodiment of a grouping of universal public-space fixtures having seating associated therewith.

FIGS. 18A, 18B, and 18C are respectively perspective, front elevational, and side elevational views of a first embodiment of a grouping of universal public-space fixtures having a shelter associated therewith.

FIGS. 19A, 19B, and 19C are respectively perspective, front elevational, and side elevational views of a second embodiment of a grouping of universal public-space fixtures having a shelter associated therewith.

FIGS. 20A and 20B are respectively perspective and side elevational views of a grouping of a third embodiment of a grouping of universal public-space fixtures having a shelter associated therewith.

FIGS. 27A, 27B, and 27C are respectively perspective, front elevational, and side elevational views of a second embodiment of a universal public-space fixture having an ash urn associated therewith.

FIGS. 28A, 28B, 28C, 28D, and 28E are respectively perspective, front elevational, left and right side elevational, and top plan views of a grouping of universal public-space fixtures having seating and a matching ash urn and trash can receptacle associated therewith.

FIGS. 29A, 29B, 29C, 29D, and 29E are respectively perspective, front elevational, side elevational, and top plan views of a grouping of universal public-space fixtures having seating and signage associated therewith.

FIGS. 30A, 30B, 30C, and 30D are respectively perspective, front elevational, side elevational, and top plan views of a fifth embodiment of a universal public-space fixture in accordance with the present invention.

DETAILED DESCRIPTION OF THE PREFERRED EMBODIMENTS

Figure 1A:
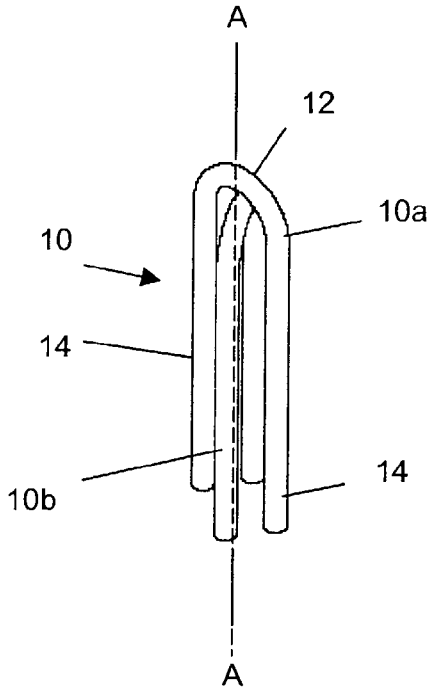
FIGS. 1A and 1B are respectively perspective and top plan views of a first embodiment of a universal public-space fixture in accordance with the present invention.
Figure 1B:
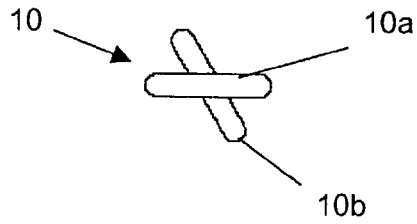

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring to FIGS. 1A-1B and 2A-2B, there are shown first and second embodiments 10 and 10' of a universal public-space fixture that, when used individually or in combination with other similar universal public-space fixtures, functions as a bollard. The structure of the universal public-space fixture 10 and 10' is based on the formation of continuous cross-sections in a series of at least two nested, inverted U-shaped forms (10*a* and 10*b* in shown FIGS. 1A and 1B; 10*a*, 10*b*, and 10*c* shown in FIGS. 2A and 2B) set around a common vertical axis A. In order to achieve a nested configuration, the substantially U-shaped forms 10*a*, 10*b*, and 10*c* are of decreasing height. Each substantially U-shaped form has an upper transverse portion 12 and two parallel, vertical legs 14 extending from the upper transverse portion 12. In the embodiments of FIGS. 1A-1B and 2A-2B, the upper transverse portion 12 is curved, with a smooth transition to the legs 14, although other configurations are possible, as discussed below.

Figure 3A:
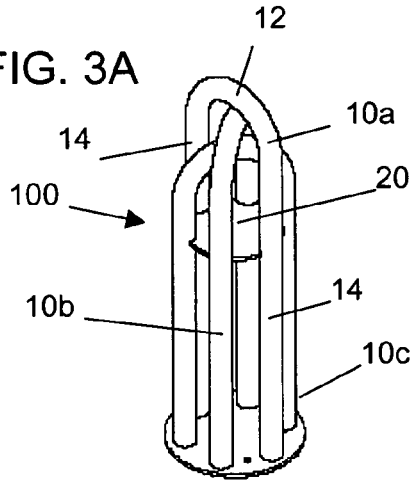
FIG. 3A is a perspective view of a third embodiment of a universal public-space fixture in accordance with the present invention.

Referring to FIG. 3A, an embodiment of a universal public-space fixture 100 is shown that includes means such as at least one center joining plate for joining the substantially U-shaped forms 10*a*, 10*b*, and 10*c* together as a unit. In this embodiment, the center joining plate is in the form of a disc 20. Preferably, the forms 10*a*, 10*b*, and 10*c* are fastened to the joining means below the upper transverse portions 12 of the forms 10*a*, 10*b*, and 10*c*. Means such as an anchor plate 24 attached to the bottom of the substantially U-shaped forms 10*a*, 10*b*, and 10*c* can also be provided to anchor the substantially U-shaped forms 10*a*, 10*b*, and 10*c* to a support surface. The "footprint" of the assembly is governed by the transverse cross-sections of the substantially U-shaped forms 10*a*, 10*b*, and 10*c* and the number of such forms that are nested.

The forms are not limited to tubing of circular cross-section, but can be made of tubing of other cross-sections including, but not limited to square or rectangular cross-sections.

FIGS. 30A-30D and FIGS. 31A-30D show fifth and sixth embodiments 110 and 110', respectively, of a universal public-space fixture in which the forms 110*a*, 110*b*, 110*c*, and 110*d* are made of tubing having a square cross section. Each substantially U-shaped form has an upper transverse portion 112 (which in the embodiment of FIGS. 30A-30D and 31A-31D is linear) and two parallel vertical legs 114. In this configuration, the upper transverse portion 112 and the legs 114 can be fit together using miter joints that are welded together to provide a continuous structure. Preferably, the universal public-space fixtures 110 and 110' include joining means such as at least one center joining plate for joining the forms 110*a*, 110*b*, 110*c*, and 110*d* together as a unit below the upper transverse portion 112. In this embodiment, the center joining plate is in the form of a square 120. Anchoring means are also provided to anchor the substantially U-shaped forms 110*a*, 110*b*, 110*c*, and 110*d* to a support surface, as discussed hereinafter.

Also, the widths of the forms (that is, the distance between the outside edges of the legs) can either be the same for all forms, which will yield a substantially circular footprint (as shown, for example, FIGS. 3A, 3B, 30A-30D, and 31A-31D), or they can be varied to yield a non-circular footprint. For example, in a universal public-space fixture comprising four forms set around a common vertical axis to form an angle of 45° between adjacent forms, alternating forms can have widths in a ratio of $1:\sqrt{2}$, which will yield a square footprint (not shown). Thus, a universal public-space fixture in which the substantially U-shaped forms are made from tubing with a circular cross-section can have a circular or non-circular footprint; and a universal public-space fixture in which the substantially U-shaped forms are made from tubing with a square cross-section also can have a circular or non-circular footprint.

For most applications, the forms 10*a*, 10*b*, and 10*c* and 110*a*, 110*b*, 110*c*, and 110*d* will have a substantially vertical orientation, and where the joining means is a center joining plate, the joining means will have a substantially horizontal orientation. However, it is contemplated that in some applications, the universal public-space fixture may have a substantially horizontal or other orientation, and the center joining plate will have a substantially vertical orientation or an orientation otherwise substantially perpendicular to that of the forms 10*a*, 10*b*, and 10*c* and 110*a*, 110*b*, 110*c*, and 110*d*.

Figure 4A:
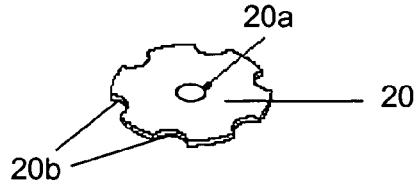
FIG. 4A is a perspective view of the joining plate of the universal public-space fixture of FIG. 3B.
Figure 4B:
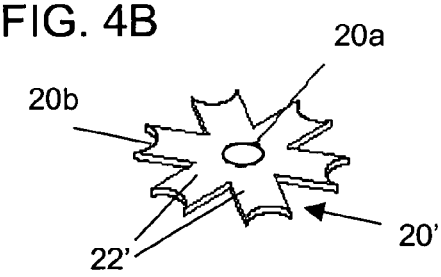
FIG. 4B is a perspective view of a first alternative embodiment of a joining plate.
Figure 3B:
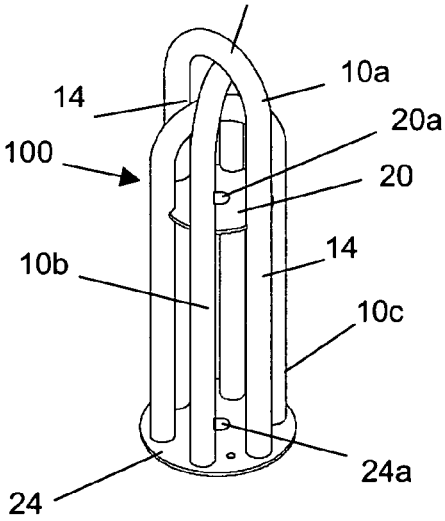
FIG. 3B is a perspective view of a fourth embodiment of a universal public-space fixture in accordance with the present invention.
Figure 4C:
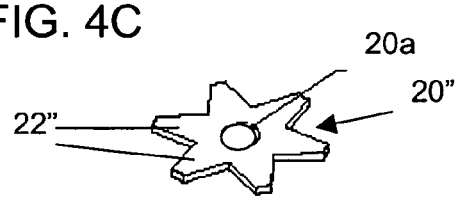
FIG. 4C is a perspective view of a second alternative embodiment of a joining plate.

The center joining plate can be a disc 20 (as shown in FIGS. 3B and 4A), a square 120 (as shown in FIGS. 30A-30D and 31A-31D), a rectangle, or other shape with notches 20*b* at the perimeter complimentary in shape to the cross-section of the legs 14 or 114 to engage facing surfaces of the legs 14 or 114. The center joining plate can also be a spider 20' or 20" (FIGS. 4B and 4C) having radiating arms 22' or 22", respectively, that engage the facing surfaces of the legs 14 or 114. FIG. 4B shows a first embodiment of a spider 20', in which the sides of the arms 22' are parallel, while FIG. 4C shows a second embodiment of a spider 20", in which the sides of the arms 22" converge. It will be appreciated by those of skill in the art that a center joining plate in the form of a spider, such as the spiders 20' and 20" as shown in FIGS. 4B and 4C can also be adapted to forms made from tubing of non-circular cross-section, such as forms 110*a*, 110*b*, 110*c*, and 110*d*. It will also be appreciated by those of skill in the art that other configurations of center joining plate can be used.

The center joining plate can have a central aperture 20*a* therein (as shown in FIGS. 3B and 4A-4C), for example to receive a center shaft (as discussed in greater detail below) for enclosing electrical lines and supporting at least one electrically-operated device, such as a lamp, or to receive a center pole for supporting a second fixture above the universal public-space fixture; although the central aperture 20*b* can be omitted, as shown and described in connection with the universal public-space fixture of FIG. 3A.

Figure 5:
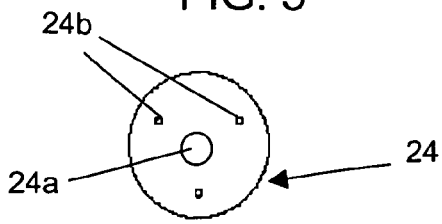
FIG. 5 is a top plan view of an anchor plate of the universal public-space fixture of FIG. 3.
Figure 6:
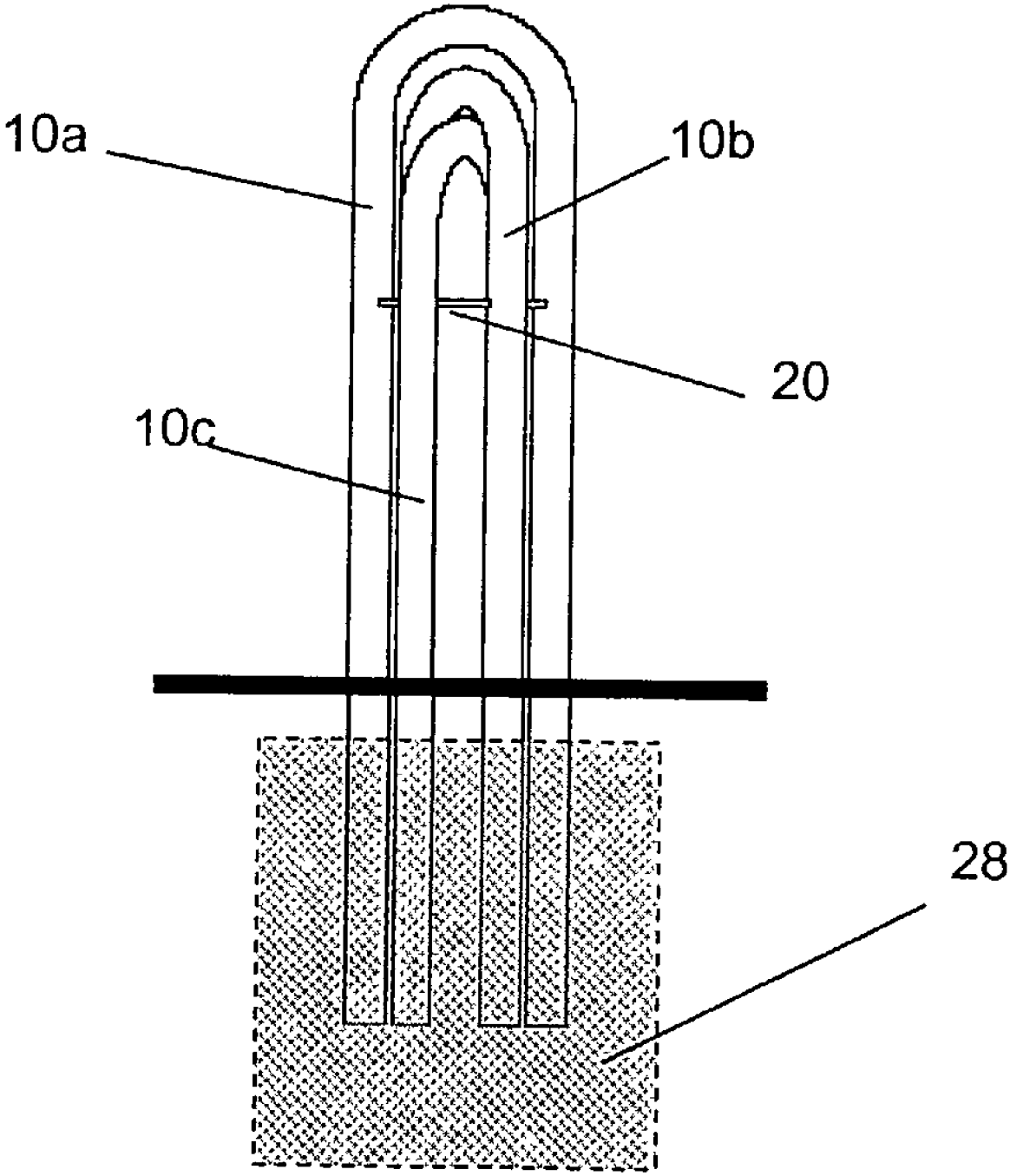
FIG. 6 is a side elevational view of a universal public-space figure anchored in a concrete footing.

Referring again to FIGS. 3A-3B, and also to FIG. 5 and FIGS. 31A-31D, the anchoring means can be an anchor plate attached to the bottoms of the forms 10*a*, 10*b*, and 10*c* and 110A, 110*b*, 110*c*, and 110*d*, for example by welding. The anchor plate can be a disc 24, as shown in FIGS. 3A-3B and 5, or a square 124, as shown in FIGS. 31A-31D, and is also fastened to a support surface (for example, pavement) by bolts or the like inserted through apertures 24*b* spaced around the anchor plate 24 or 124 inward of its perimeter. Like the joining means and for the same purpose, the anchor plate can have a central aperture 24*a*, as shown in FIGS. 3B and 5 in connection with the anchor plate 24. Alternatively, the bottoms of the forms 10*a*, 10*b*, and 10*c* and 110*a*, 110*b*, 110*c*, and 110*d* can be buried in the ground, preferably anchored in a concrete footing 26, as shown in FIG. 6 and FIGS. 30A-30D. When the forms 10*a*, 10*b*, and 10*c* are anchored in a concrete footing 26, the anchor plate 24 can be omitted.

Figure 2A:
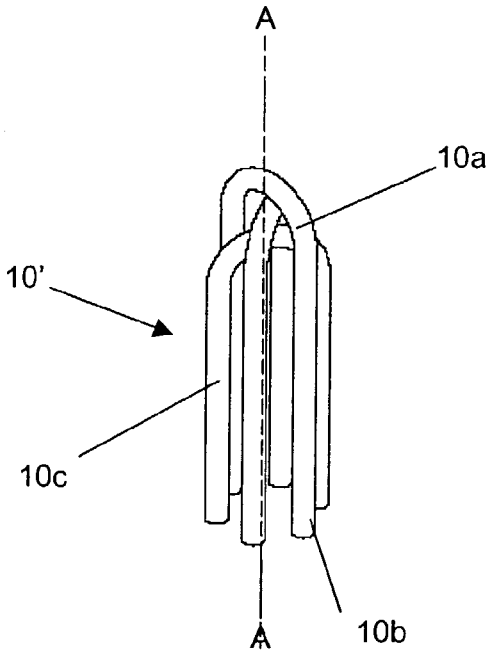
FIGS. 2A and 2B are respectively perspective and top plan views of a second embodiment of a universal public-space fixture in accordance with the present invention.
Figure 2B:
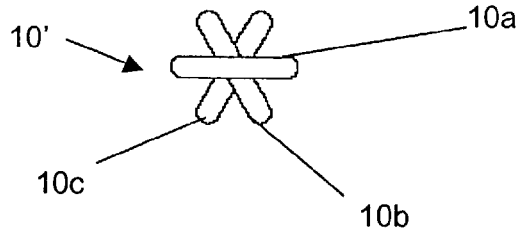

In one embodiment, shown in FIGS. 2A-2B, the universal public-space fixture has three substantially U-shaped forms 10*a*, 10*b*, and 10*c* of 2⅜ inch O.D. steel pipe, with the substantially U-shaped forms 10*a*, 10*b*, and 10*c* being at an angle of 120° to each other. The footprint formed represents a circle.

The size and strength of the material used can have a significant effect on the behavior and strength of the finished universal public-space fixture. For example, with no change in general appearance, using standard schedule 40 pipe will provide one set of characteristics, while using high-tensile-strength tubular steel of the same outer diameter will yield far different characteristics. Moving the center joining plate up or down, or changing the cross-section of the tubing used to make the forms, or increasing the heights of the substantially U-shaped forms, or changing the configuration of the joining plate, or adding additional joining plates will also have a significant effect on the characteristics of the fixture. Filling the inside of the substantially U-shaped forms with concrete or other filler materials will yield other results. Using multiple universal public-space fixtures of different heights (the height of each universal public-space fixture being determined by the height of its tallest substantially U-shaped form) placed adjacent to each other as shown and described in connection with FIGS. 7A-7C will also result in different characteristics, as will joining or linking universal public-space fixtures together using seating sections shown and described in connection with 11A-11C, 12A-12D, 13A-13D, 14A-14D, and 14A-15D, or a sign frame as shown and described in connection with FIGS. 29A-29D, or the canopy of a shelter as shown and described in connection with FIGS. 18A-18C, 19A-19C, and 20A-20B, as functional and structural elements. There are conflicting requirements for strength, rigidity, and ductility that must be addressed.

Assume, for example, that a car is deliberately or accidentally driven toward a facility in which a plurality of the universal public-space fixtures in accordance with the invention are arrayed in front of it as bollards. Also assume, for example, that the strength of the anchoring means anchoring the bollards to the ground is sufficient to restrain the fastened portion of each bollard over a known and defined range. Such anchoring means include but are not limited to an anchor plate 24 or 124 held in place by anchor bolts, the extended ends of the legs 14 or 114 held in concrete footings 26, and an in-ground assembly acting as a receiver for the legs 14 or 114 or a joining plate (which would make the bollard removable), etc. Such anchoring means can also include a radially-extending assembly below ground.

When a vehicle strikes the outer circumference of the vertical bollard either used by itself or as part of a larger assembly, it is intended that the bollard will initiate a reaction similar to the concept of the "crumple zone" in automobile design. The energy of the impact will deform the bollard significantly. The horizontal energy of the crash will be deflected in a series of distortions that are both vertical and horizontal, with most of the horizontal energy being deflected in the vertical legs 14. The steel will deform, stretch, and translate energy to the adjacent sections of the substantially U-shaped forms, the joining plates, and any other elements attached to them.

The energy needed to tear, bend, or deform each element of the bollard can be defined by the grade, weight, and characteristics of the material used. In the absorption of energy, the bollard will deform such that enormous energy is absorbed in the translating of the horizontal vector of the collision into the vertical and horizontal distortion of the bollard elements into the bollard cross-section itself. The relationship of the height of the arches, the placement of the joining plates, the number of joining plates, the number of arches, the combination of bollards, etc., all provide enormous flexibility in a homogeneous design motif. Similarly, using other attached elements, including benches, increases the area and function of the "crumple zone" significantly, distributing energy over more space, material, linked bollards, etc.

As discussed above, the joining plates can be in the form of a steel or other disc 20 (FIGS. 3B and 4), a square (FIGS. 30A-30D and 31A-31D) or "spider" framework (FIGS. 4B and 4C) that allows for more or less movement of the individual sections of each substantially U-shaped form. Likewise, changing the height of the inverted substantially U-shaped forms and the number, type, and placement of the joining elements can provide design flexibility in matching sections of the universal public-space fixture to the intended use.

Examples of applications of the universal public-space fixture to public-space systems or assemblies are shown and described in connection with FIGS. 7A-7C, 8A-8C, 9A-9C, 10A-10C, 11A-11D, 12A-12D, 13A-13D, 14A-14D, 15A-15D, 16A-16D, 17A-17D, 18A-18C, 19A-19C, 20A-20B, 21A-21B, 22A-22C, 13A-23D, 24A-24B, 25A-25B, 26A-26C, 27A-27C, 28A-28D, and 29A-29D, and include, but are not limited to barriers, seating, lighting, signage, shelters, and litter control. The universal public-space fixture can be used in a system comprising one or more other universal public-space fixtures and/or site amenities (for example, seating, lighting, signage, shelters, trash can receptacles, and ash urns) that adds security to the usual functions of site amenities. For example, as shown in FIGS. 7A-7C, a plurality of universal public-space fixtures 100 in accordance with the invention can be placed in a grouping 30 for use as a barrier, with a universal public-space fixture 30*a* of a first height at the center, and the other universal public-space fixtures 30*b* of a second, shorter height spaced circumferentially around the first, center universal public-space fixture 30*a*. In the embodiment of FIGS. 7A-7C, four universal public-space fixtures 30*b* are equidistantly spaced around the center universal public-space fixture 30*a*. However, it will be appreciated by those of ordinary skill in the art that the number of second, circumferential universal public-space fixtures 30*b*, as well as their size and spacing, can be varied according to the intended use, available space, and esthetic considerations. It will also be appreciated by those of skill in the art that it is possible to vary the configuration of the universal public-space fixtures used in a grouping 30, for example by changing the number and/or cross-section of substantially U-shaped forms (as shown and described, for example, in connection with FIGS. 30A-30D and FIGS. 31A-31D), by changing the number and configuration or type of the joining means (as shown and described in connection with FIGS. 4A-4C), and by changing the configuration or type of anchoring means.

With minor changes in fastening hardware, one or more universal public-space fixtures can be used as supports for installing seating, lighting, signage, shelters, etc., with secure and protected electrical connections (where needed), flexible spacing, etc. For example, seating can be installed around a single universal public-space fixture 100 (FIGS. 8A-8C, 9A-9C, and 10A-10C) or around a grouping of two or more universal public-space fixtures 100 (FIGS. 11A-

11D, 12A-12D, 13A-13D, 14A-14D, 15A-15D, 16A-16D, and 17A-17D); lamps can be installed within or above a universal public-space fixture 100 (FIGS. 21A-21B); signage can be supported by a single universal public-space fixture 100 or between a pair of universal public-space fixtures 100 (FIGS. 29A-29D); a shelter can be supported by two or more universal public-space fixtures 100 (FIGS. 18A-18C, 19A-19C, and 20A-20B); and trash can receptacles and/or ash urns can be supported by a single universal public-space fixture 100 (FIGS. 22A-22C, 23A-23D, 24A-24B, 25A-25B, 26A-26C, and 27A-27C) or between a pair of universal public-space fixtures (not shown) or on separate universal public-space fixtures 100 in a system of at least one universal public-space fixture and at least one site amenity (FIGS. 28A-28D). In some embodiments the at least one site amenity will function to join or link together at least two universal public-space fixtures 100 to provide a public-space system having different behavior and strength characteristics than a single universal public-space fixture 100.

It will also be appreciated by those of skill in the art that it is possible to vary the configuration of the universal public-space fixture combined with the site amenities, for example by changing the number and/or cross-section of substantially U-shaped forms (as shown and described, for example, in connection with FIGS. 30A-30D and FIGS. 31A-31D), by changing the number and configuration or type of the joining means (as shown and described in connection with FIGS. 4A-4C), and by changing the configuration or type of anchoring means.

Referring to FIGS. 8A-8C, 9A-9C, and 10A-10C, there are shown three embodiments in which a single universal public-space fixture 100 has seating fixtures in the form of fan-shaped benches 40 associated therewith. In the embodiment shown in FIGS. 8A-8C, the fan-shaped benches 40 are installed around the universal public-space fixture 100, supported by pedestals 42 set into a support surface radially outwardly from the universal public-space fixture 100. In the embodiments shown in FIGS. 9A-9C and 10A-10C, the fan-shaped benches 40 are attached to the universal public-space fixture 100 by different styles of brackets 44 and 44'. It will be appreciated by those of skill in the art that either multiple seating fixtures or a single, continuous seating fixture can be associated with the universal public-space fixture 100, that the seating fixture can be solid, slatted, latticed, and other styles; and that the style of brackets and pedestals used to support the seating fixtures are not limited to those illustrated, but can be selected from any other style suitable to the intended use.

Referring to FIGS. 11A-11D, 12A-12D, 13A-13D, 14A-14D, 15A-15D, 16A-16D, and 17A-17D, there are shown seven embodiments in which groupings of at least two universal public-space fixtures 100 have at least one seating fixture associated therewith. FIGS. 11A-11D, 12A-12D, and 13A-13D show embodiments in which the universal public-space fixtures 100 are arranged in a line. In the embodiment shown in FIGS. 11A-11D, two universal public-space fixtures 100 are spaced apart, and brackets 44 attached to the universal public-space figures support an elliptical bench 50, the vertical axes of the universal public-space fixtures 100 being positioned approximately at the foci of the ellipse. The embodiment of FIGS. 12A-12D is similar to the embodiment of FIGS. 11A-11D, except that three, rather than two universal public-space fixtures 100 are provided. The embodiment of FIGS. 13A-13D is similar to the embodiment of FIGS. 11A-11D, except that the curved portions of the bench 50 and their supporting brackets 44 are omitted, so that the seating fixture comprises two separate rectangular benches 52, between which the two universal public-space fixtures 100 are sandwiched.

FIGS. 14A-14D, 15A-15D show embodiments in which three universal public-space fixtures 100 are arranged in a triangle. In the embodiment shown in FIGS. 14A-14D, brackets 44 attached to the universal public-space fixtures 100 support a separate rectangular bench 52 on each side of the triangle. In FIGS. 15A-15D, brackets 44 attached to the universal public-space fixtures 100 support a triangular bench 54 around the universal public-space fixtures 100.

In FIGS. 16A-16D, four fan-shaped benches 40 are associated (by attachment with brackets 44) with the exterior public-space fixtures 100 in a grouping 30 of five universal public-space fixtures 100 arranged as described in connection with FIGS. 7A-7C. The embodiment of FIGS. 17A-17D is similar to the embodiment of FIGS. 16A-16D, except that the universal public-space fixtures 100 are more closely spaced to each other.

Figure 8A:
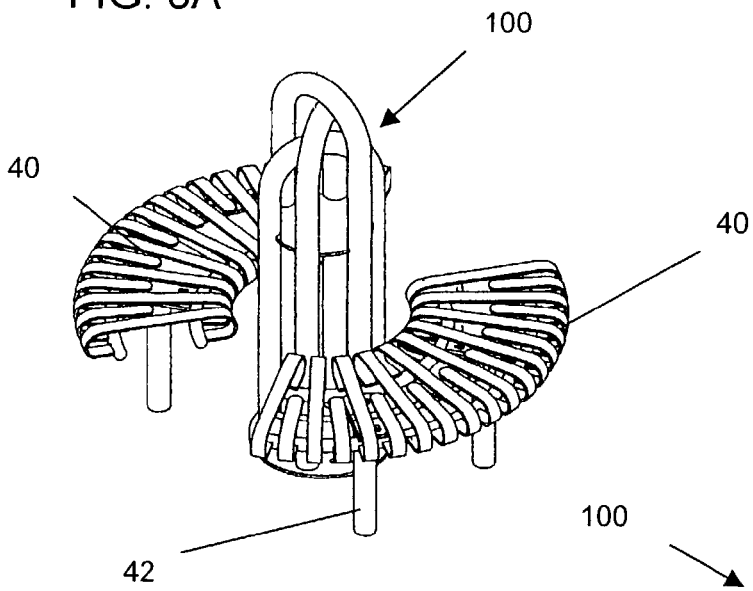
FIGS. 8A, 8B, and 8C are respectively perspective, side elevational, and top plan views of a first embodiment of a single universal public-space fixture having seating associated therewith.
Figure 8B:
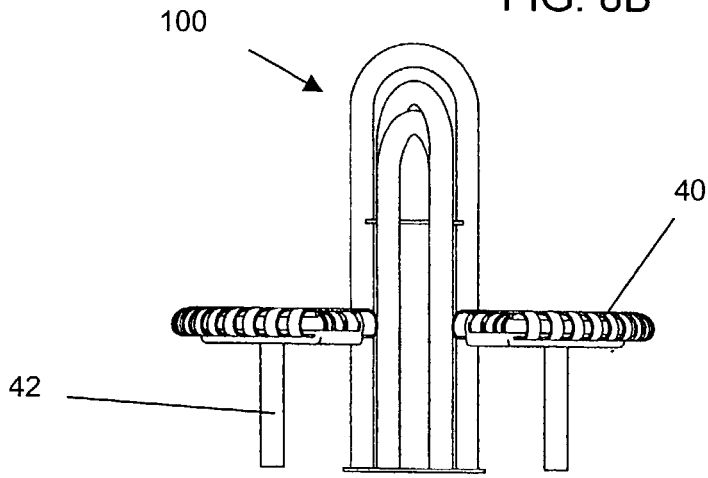
Figure 8C:
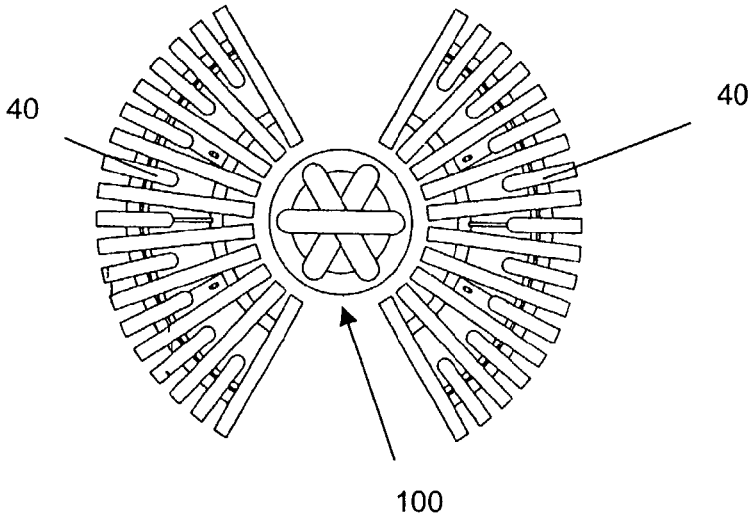
Figure 10A:
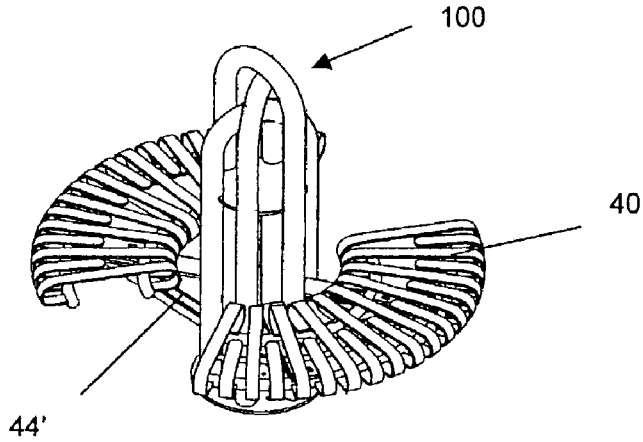
Figure 10A:
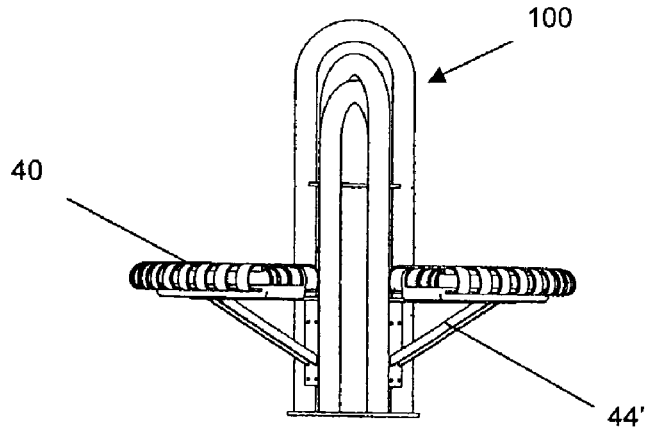
Figure 10A:
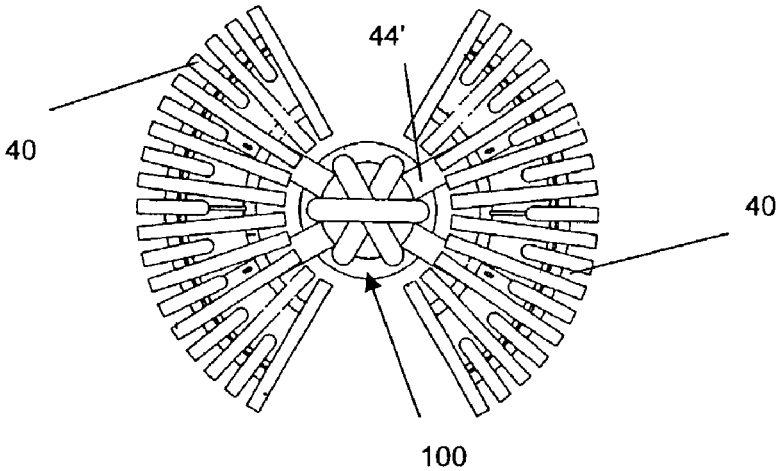
Figure 11A:
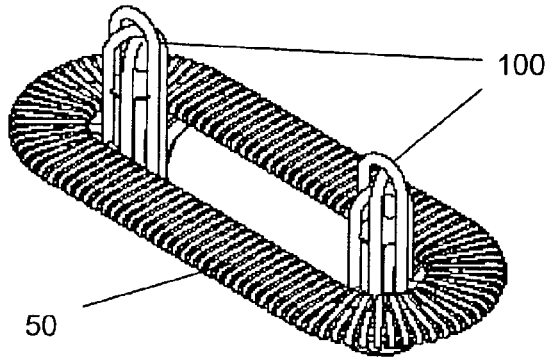
FIGS. 11A, 11B, 11C, and 11D are respectively perspective, front elevational, side elevational, and top plan views of a first embodiment of a grouping of universal public-space fixtures having seating associated therewith.
Figure 11B:
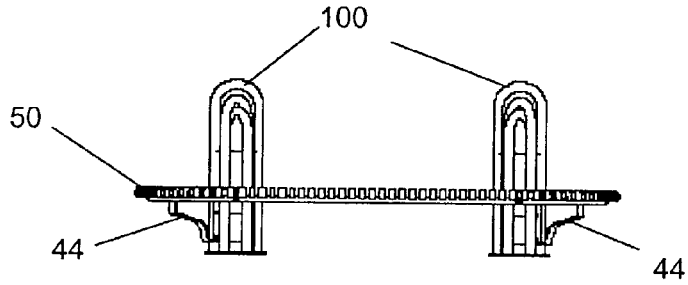
Figure 11C:
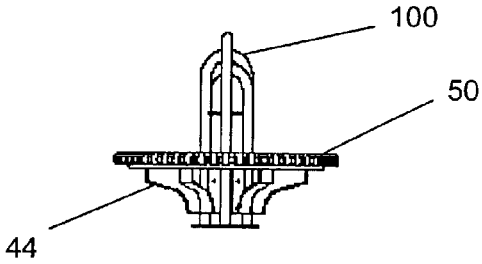
Figure 11D:
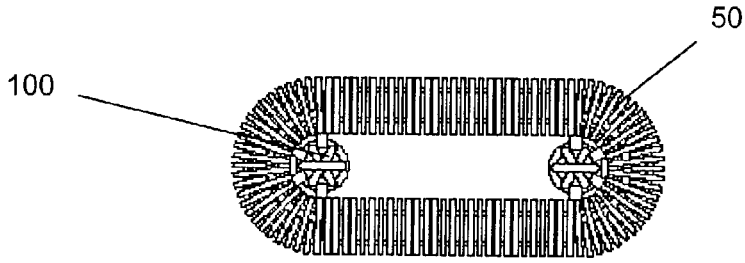
Figure 12A:
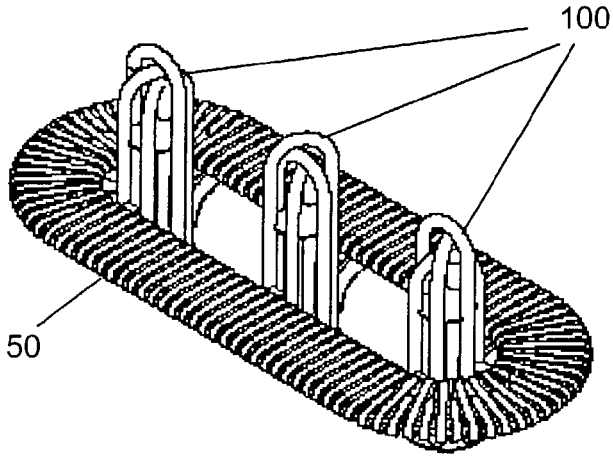
FIGS. 12A, 12B, 12C, and 12D are respectively perspective, front elevational, side elevational, and top plan views of a second embodiment of a grouping of universal public-space fixtures having seating associated therewith.
Figure 12B:
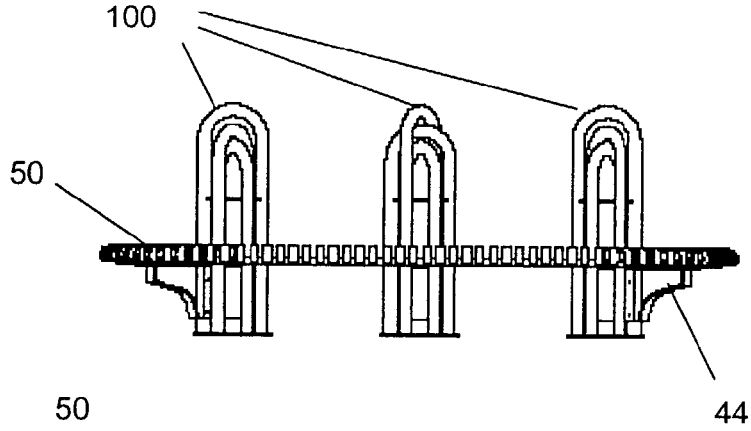
Figure 12C:
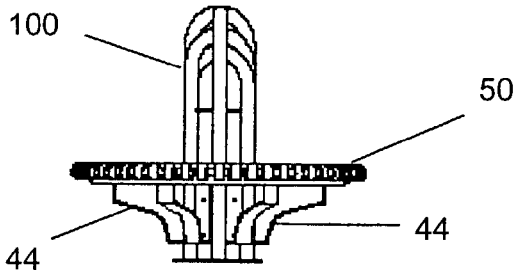
Figure 12D:
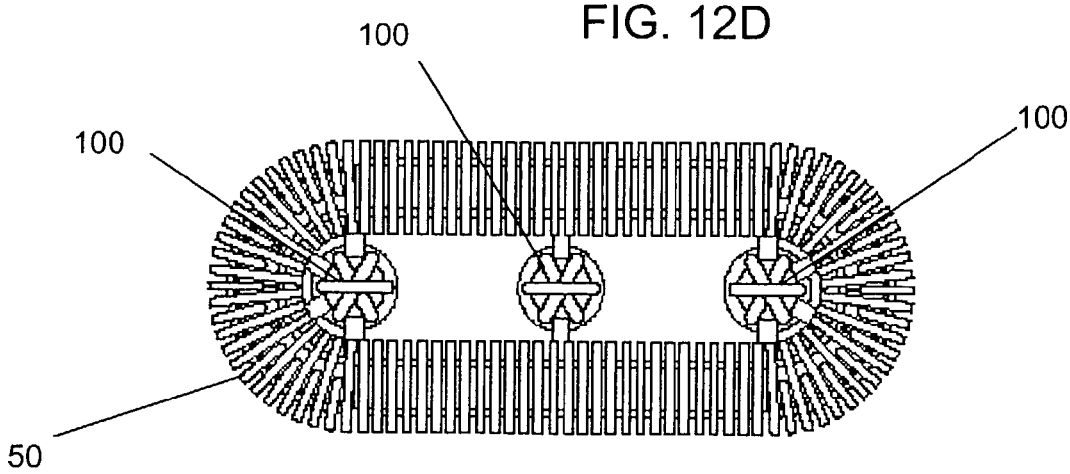
Figure 14A:
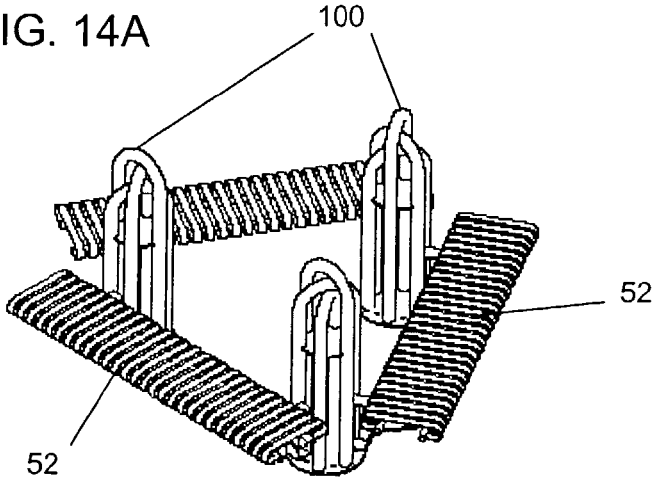
FIGS. 14A, 14B, 14C, and 14D are respectively perspective, front elevational, side elevational, and top plan views of a fourth embodiment of a grouping of universal public-space fixtures having seating associated therewith.
Figure 14D:
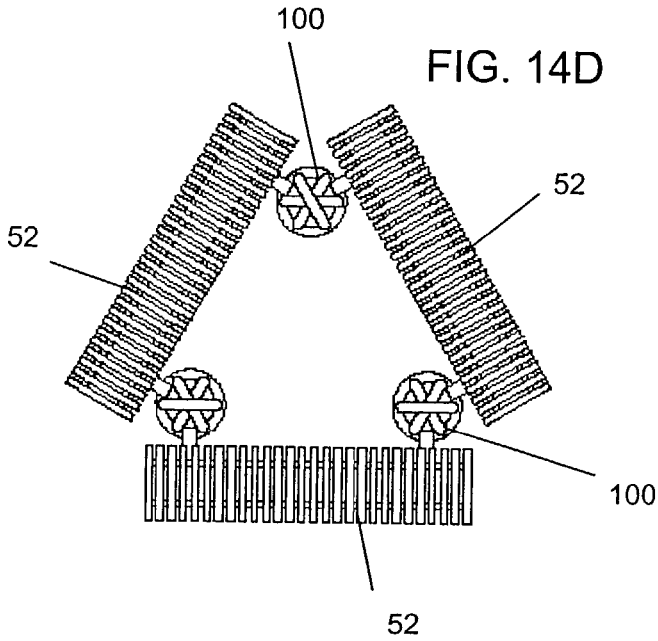
Figure 14B:
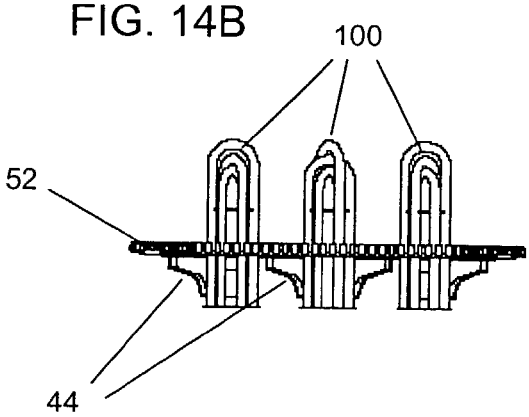
Figure 14C:
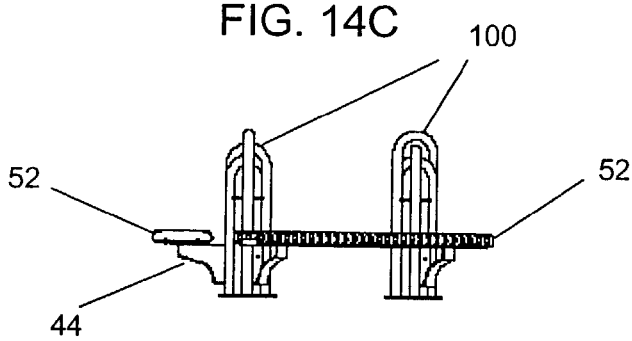
Figure 15A:
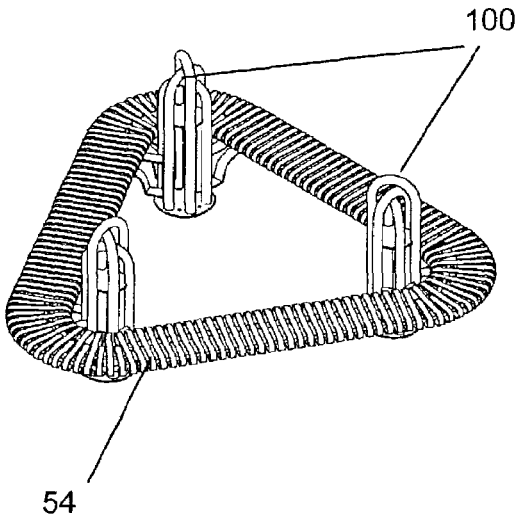
FIGS. 15A, 15B, 15C, and 15D are respectively perspective, front elevational, side elevational, and top plan views of a fifth embodiment of a grouping of universal public-space fixtures having seating associated therewith.
Figure 15B:
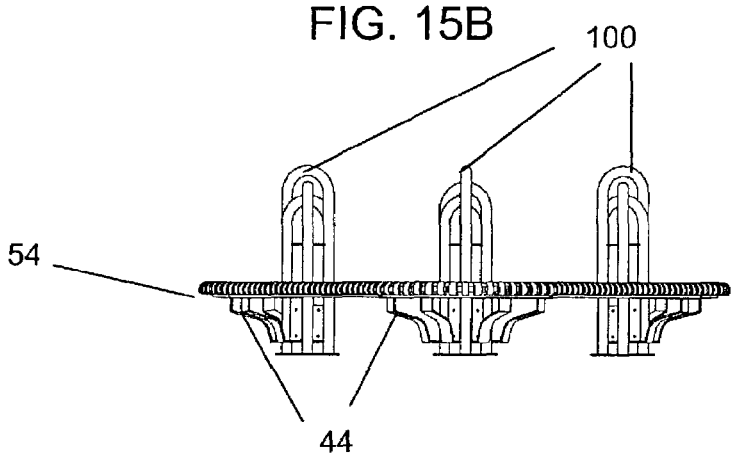
Figure 15D:
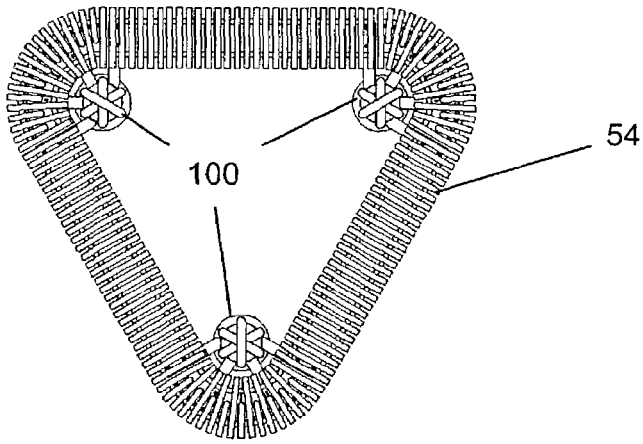
Figure 15C:
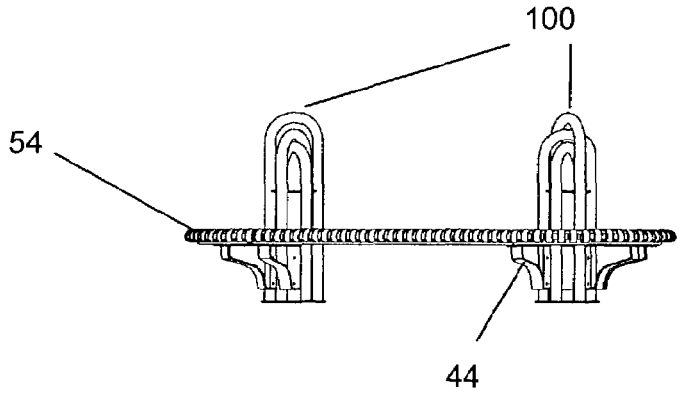
Figure 17A:
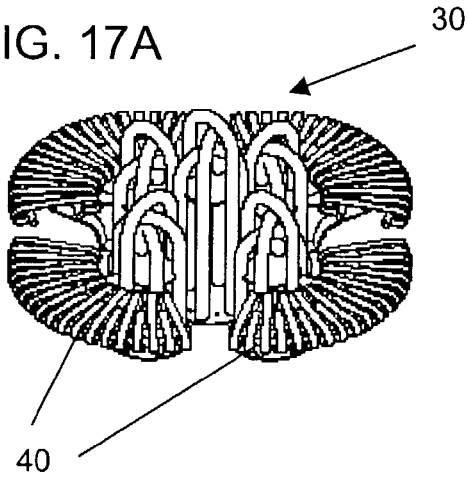
FIGS. 17A, 17B, 17C, and 17D are respectively perspective, front elevational, side elevational, and top plan views showing a seventh embodiment of a grouping of universal public-space fixtures having seating associated therewith.
Figure 17B:
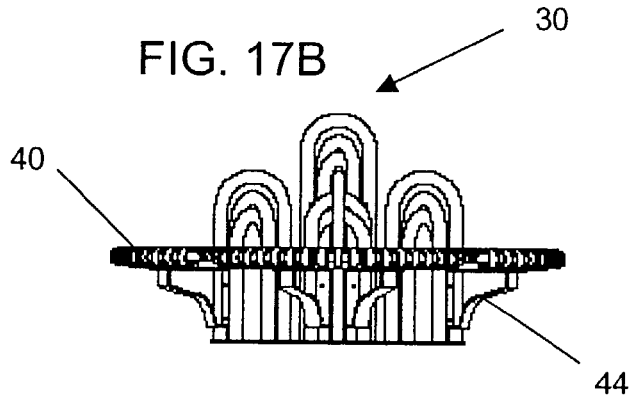
Figure 17C:
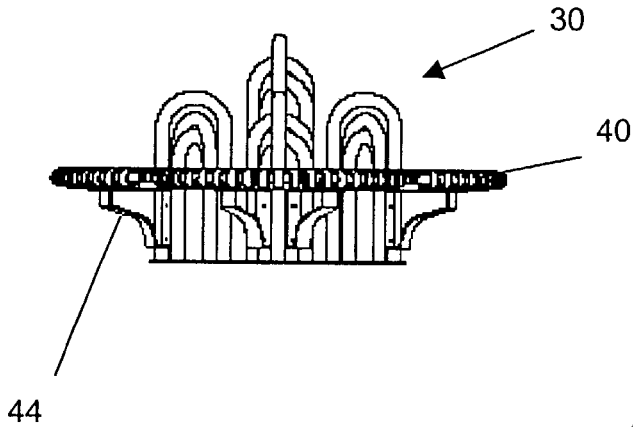
Figure 17D:
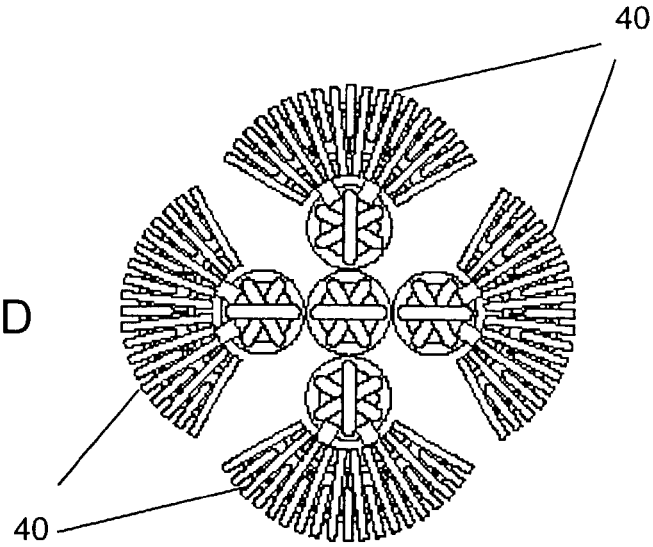

It will be appreciated by those of skill in the art that the configuration of the seating fixtures and their supports can be varied in any manner suitable to their intended use, and taking into account esthetic considerations. For example, a pair of universal public-space fixtures 100 can be surrounded by an elliptical bench 50, as in the embodiment of FIGS. 11A-11D, sandwiched between a pair of rectangular benches 52, as in the embodiment of FIGS. 13A-13D, or can even be associated with a single bench 52 between them; and more than two universal public-space fixtures 100 can be arranged in a line between the seating fixtures, as shown in FIGS. 12A-12D. The embodiments of FIGS. 14A-14D and FIGS. 15A-15D can be modified for use with more than three universal public-space fixtures 100, with the universal public-space fixtures 100 being positioned at the vertices of a polygon, and the seating fixture or fixtures being configured accordingly, with a separate seating fixture (for example, a rectangular bench 52) on each side of the polygon or a polygonal bench extending around the universal public-space fixtures 100. Similarly, the embodiments of FIGS. 16A-16D and 17A-17D can be modified for use with two, three, or more than four public-space fixtures 100, with the shape of the fan-shaped benches 40 being adjusted in accordance with the spacing of the universal public-space fixtures 100; and can also be modified by adjusting the spacing between the public-space fixtures 100, as shown in FIGS. 17A-17D. Also, the seating fixtures can be attached to the universal public space fixtures 100 by brackets of any suitable configuration, such as brackets 44 or 44' as shown in FIGS. 9A-9C, 10A-10C, 11A-11D, 12A-12D, 13A-13D, 14A-14D, and 15A-15D; or can be supported on pedestals, such as pedestals 42 as shown in FIGS. 8A-8C, in close proximity to the universal public space fixtures 100.

It will also be appreciated by those of skill in the art that it is possible to vary the configuration of the universal public-space fixture combined with the various seating fixtures and their supports, for example by changing the number and/or cross-section of substantially U-shaped forms (as shown and described, for example, in connection with FIGS. 30A-30D and FIGS. 31A-31D), by changing the number and configuration or type of the joining means (as shown and described in connection with FIGS. 4A-4C), and by changing the configuration or type of anchoring means.

Referring to FIGS. 18A-18C, 19A-19C, and 20A-20C, there are shown three embodiments 60, 60', and 60" of shelters in which a canopy is supported by multiple public-space fixtures. In the embodiment of FIGS. 18A-18B, the shelter 60 comprises a pair of universal public-space fixtures 100, a canopy 62 above and spaced from the universal public-space fixtures 100, and a pair of brackets 64 extending outwardly from opposite sides of the upper transverse portion 12 of on one of the forms 10*a*, 10*b*, and 10*c*, in this case shortest of the forms, 10*c*. Alternatively, the canopy 62 can be supported by center poles 64' extending through and above a pair of spaced public-space fixtures 100', as shown in FIGS. 19A-19C. The center poles 64' extend through the universal public-space fixtures 100' to the bottom of the substantially U-shaped forms 10*a*, 10*b*, and 10*c*, and the center joining plates 20 of the universal public-space fixtures 100' have a central aperture 20*a* therein, for receiving the center poles 64'. In the embodiment of FIGS. 20A-20B, the shelter 60" comprises a canopy 62" supported by four center poles 64' arranged in a rectangle and extending from four correspondingly arrange public-space fixtures 1000. Each of the universal public-space fixtures 1000 has two center joining plates 20, spaced vertically along the vertical axis of the universal public-space fixtures 1000.

It will be appreciated by those of skill in the art that the shape and size of the canopy can be varied according to the intended use and esthetic considerations. Such variations include, but are not limited to, a shape that is elliptical in outline, as shown in FIGS. 18A-18C and 19A-19C, a shape that is peaked, as also shown in FIGS. 18A-18C and 19A-19C, a shape that is rectangular in outline, as shown in FIGS. 20A-20B, and a shape that is bowed, as also shown in FIGS. 20A-20B. Similarly, the number of public-space fixtures used to support the canopy can be varied, for example by arranging at least two in spaced linear fashion, as shown in FIGS. 18A-18C and 19A-19C, or by using multiple pairs as shown in FIGS. 20A-20B. As will be appreciated by those of skill in the art, the length of the shelter can be increased by increasing the number of universal public-space fixtures used to support the canopy. As also will be appreciated by those of skill in the art, the shelter can also include other site amenities, such as one or more fan-shaped benches 40 associated with each universal public-space fixture 100 or 100', or at least one rectangular bench 52 or elliptical bench 50 associated with pairs of the universal public-spaced fixtures 100 or 100'.

Figure 21A:
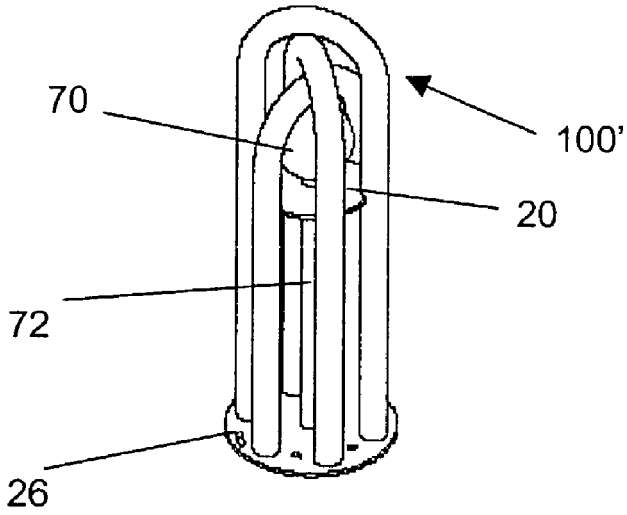
FIGS. 21A and 21B are respectively perspective and side elevational views of a universal public-space fixture having a lamp associated therewith.
Figure 21B:
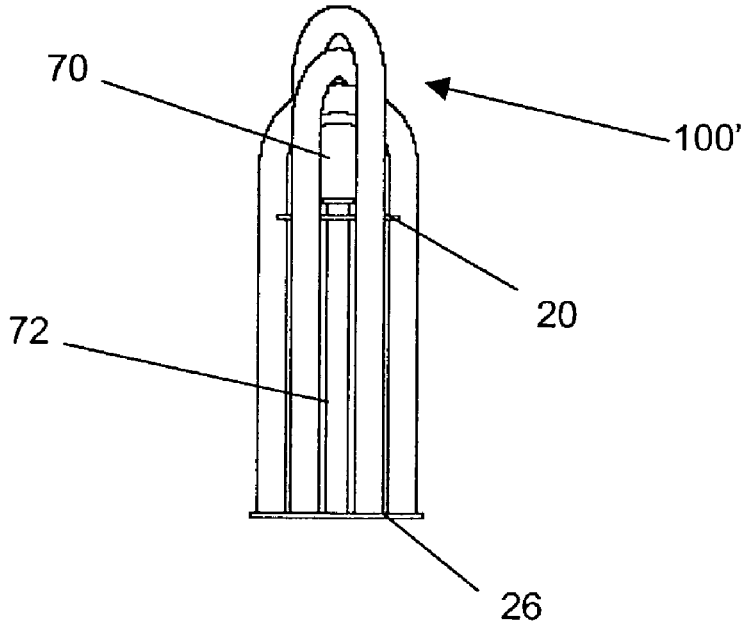

Referring to FIGS. 21A and 21B, there is shown a universal public-space fixture 100' having a lamp 70 installed therein. In this embodiment, both the center joining plate 20 and the anchor plate 24 have apertures 20*a* therethrough to accommodate a center shaft 72 for enclosing electrical lines (not shown) and supporting the lamp 70, and the shaft 72 terminates just above the center joining plate 20 so that the lamp 70 supported thereby is fully enclosed by the upper end of the universal public-space fixture 100'. It will be appreciated by those of skill in the art that the shaft 72 can be extended above the universal public-space fixture 100' so that the lamp 70 is above it, rather than enclosed by it.

Figure 22A:
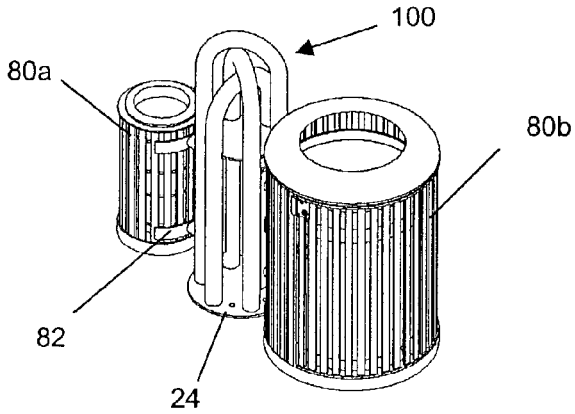
FIGS. 22A, 22B, and 22C are respectively perspective, front elevational, and side elevational views of a first embodiment of a universal public-space fixture having a matching ash urn and trash can receptacle associated therewith.
Figure 22B:
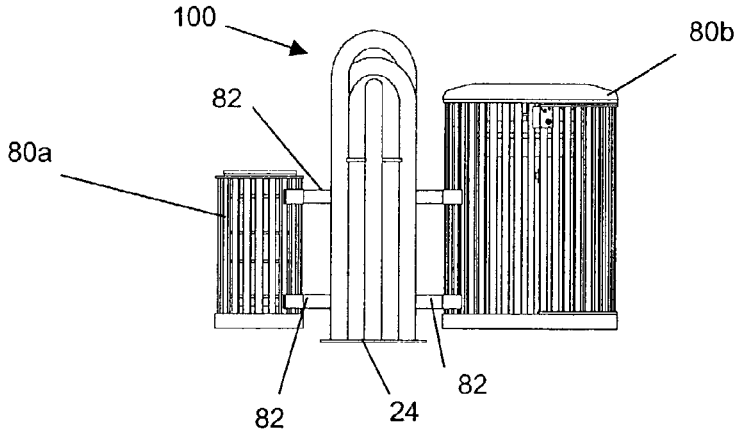
Figure 22C:
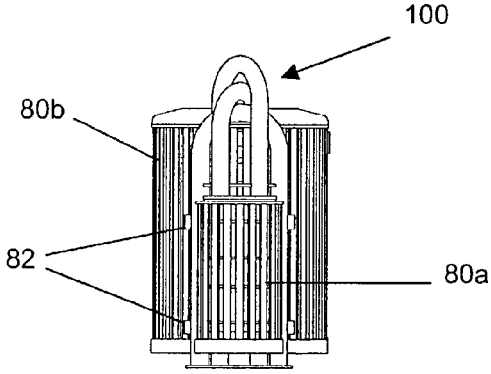
Figure 23A:
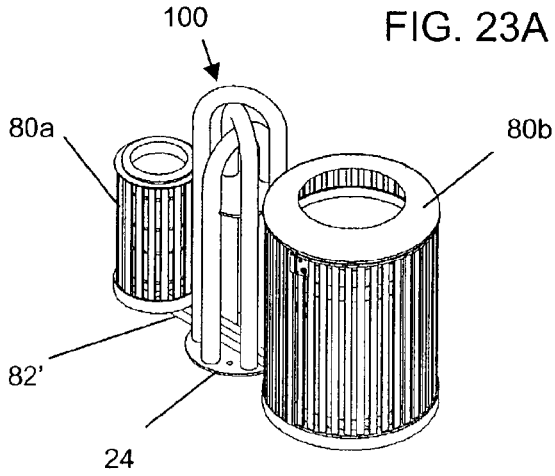
FIGS. 23A, 23B, 23C, and 23D are respectively perspective, front elevational, side elevational, and top plan views of a second embodiment of a universal public-space fixture having a matching ash urn and trash can receptacle associated therewith.
Figure 23B:
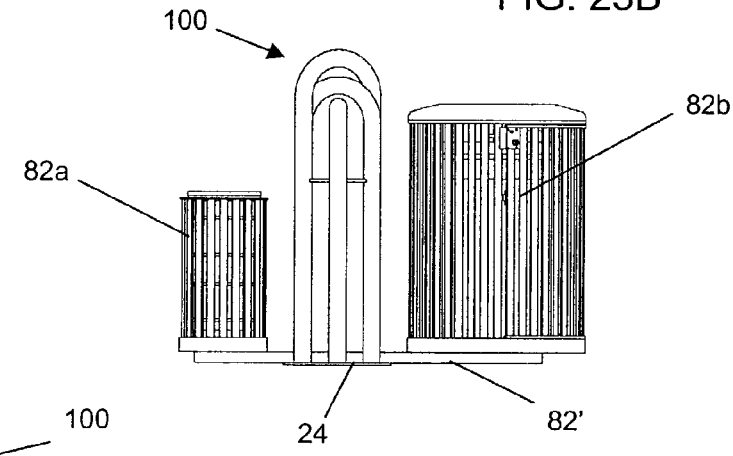
Figure 23C:
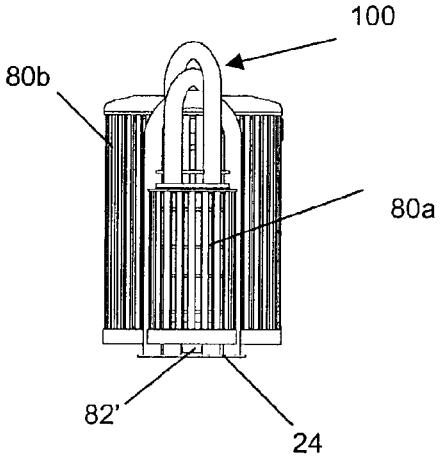
Figure 23D:
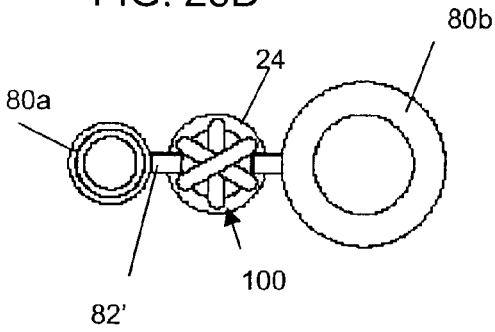
Figure 24A:
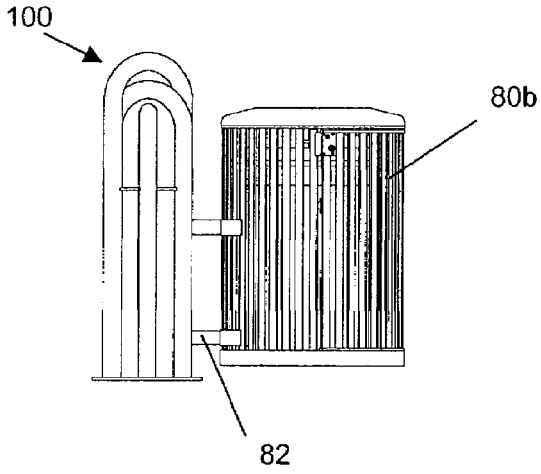
FIGS. 24A and 24B are respectively perspective and side elevational views of a first embodiment of a universal public-space fixture having a trash can receptacle associated therewith.
Figure 24B:
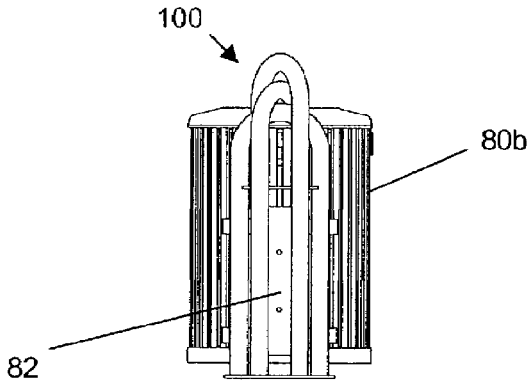
Figure 25A:
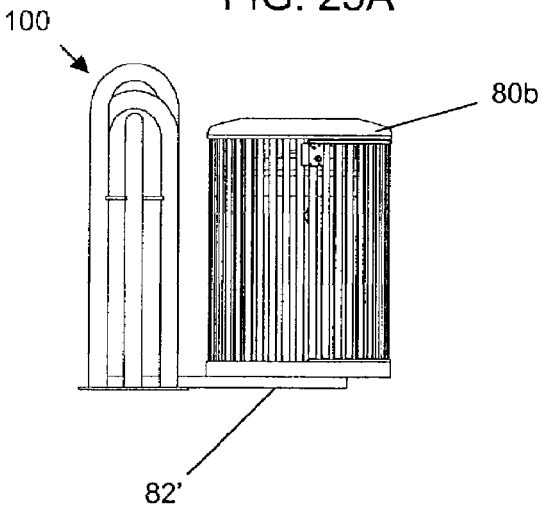
FIGS. 25A and 25B are respectively perspective and side elevational views of a second embodiment of a universal public-space fixture having a trash can receptacle associated therewith.
Figure 25B:
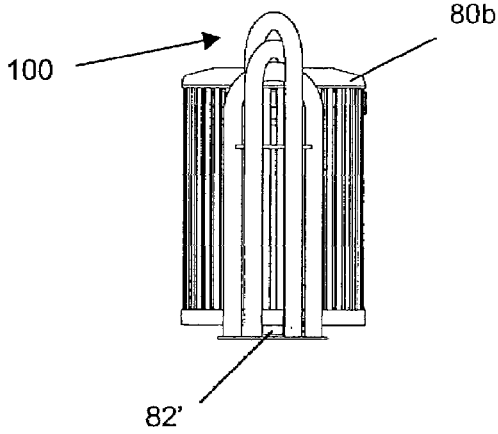
Figure 26A:
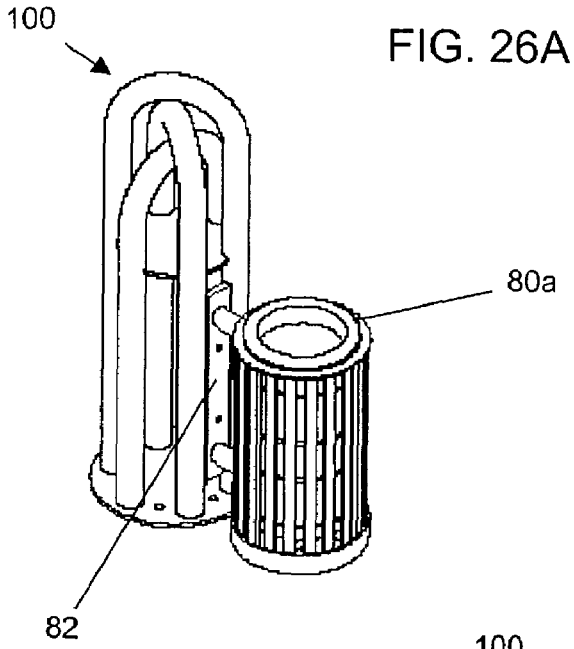
FIGS. 26A, 26B, and 26C are respectively perspective, front elevational, and side elevational views of a first embodiment of a universal public-space fixture having an ash urn associated therewith.
Figure 26B:
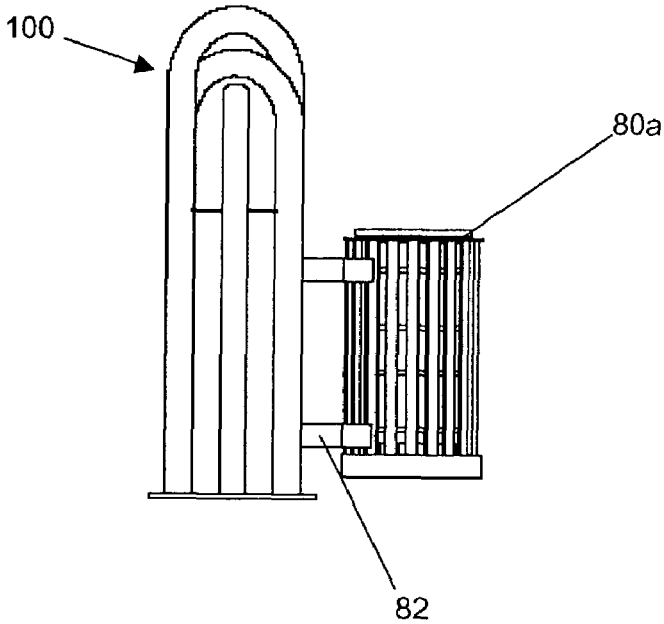
Figure 26C:
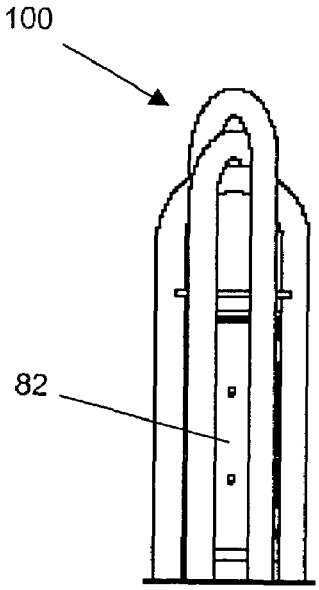
Figure 31A:
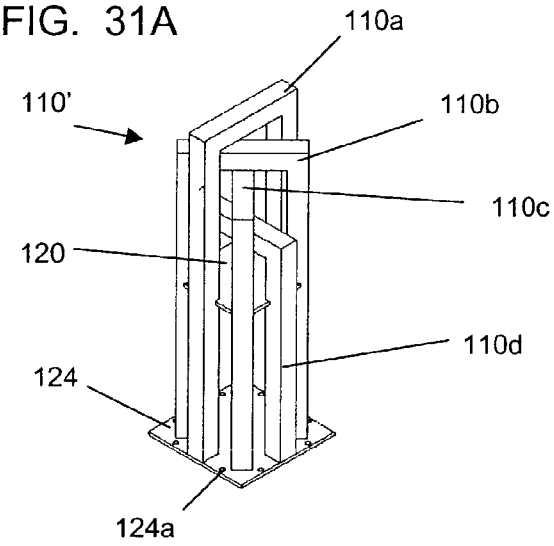
FIGS. 31A, 31B, 31C, and 31D are respectively perspective, front elevational, side elevational, and top plan views of a sixth embodiment of a universal public-space fixture in accordance with the present invention.
Figure 31D:
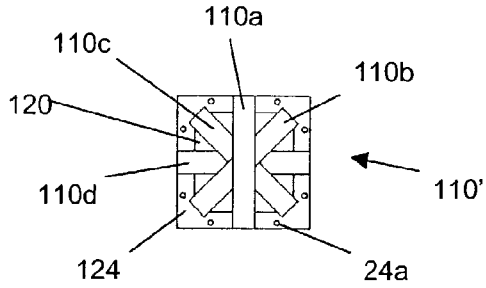
Figure 31B:
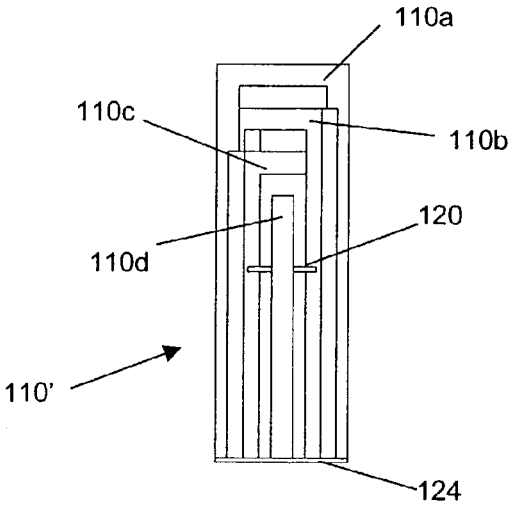
Figure 31C:
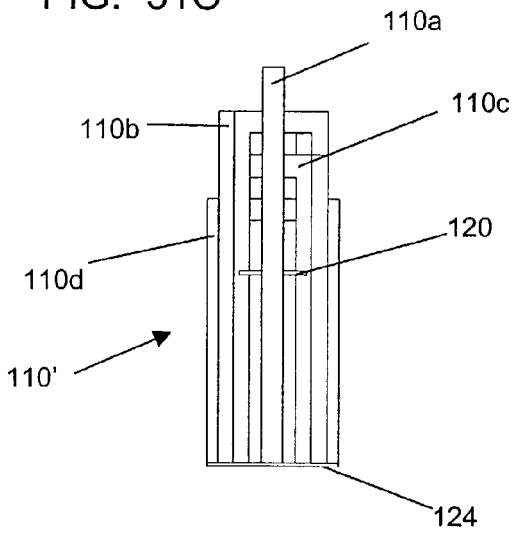
Figure 32A:
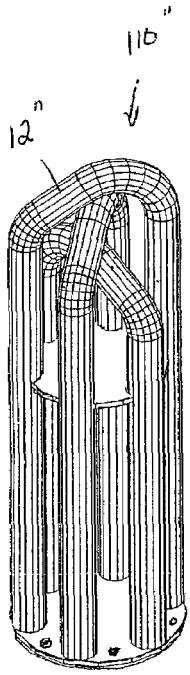
FIGS. 32A, 32B, 32C, and 32D are respectively first perspective, second perspective, first side elevational, and second side elevational views of a seventh embodiment of a universal public-space fixture in accordance with the present invention.
Figure 32B:
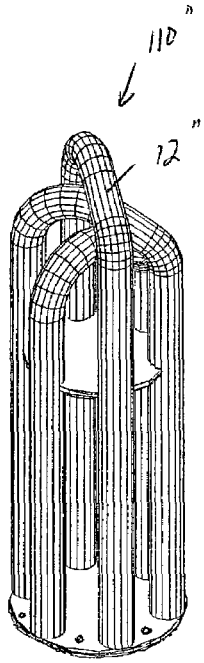
Figure 32C:
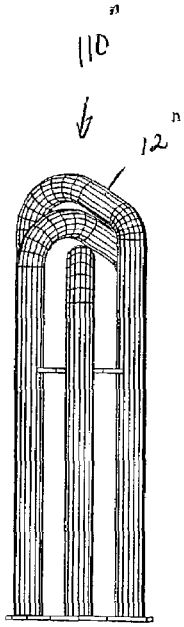
Figure 32D:
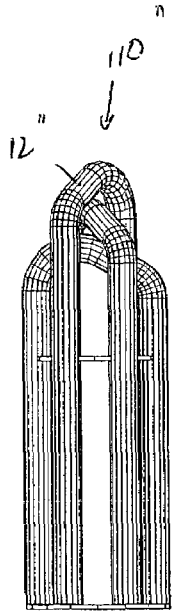

Referring to FIGS. 22A-22B and 23A-23B, there are shown two embodiments of an ash urn 80*a* and matching trash can receptacle 80*b*, associated with a universal public-space fixture 100. In the embodiment of FIGS. 22A-22B, the brackets 82 are attached at one end between adjacent legs 14 of two substantially U-shaped forms and at the other end to the sides of the ash urn 80*a* and trash can receptacle 80*b*. In the embodiment of FIGS. 23A-23B, a single bracket 82' is provided, attached at its center portion to the top of the anchor plate 24 and at the ends to the bottoms of the ash urn 80*a* and the trash can receptacle 80*b*. It will be appreciated by those of skill in the art that the ash urn 80*a* and trash can receptacle 80*b* can have a variety of configurations (examples of different configurations include, but are not limited to the designs of U.S. Pat. Nos. D304,253, D304,632, D314,461, D322,347, D322,348, D322,702, D353,250, D417,053, D441,932, D445,982, D450,166, D452,760, D454,238, D458,431, D460,591, D460,592, D460,593, D461,939, which are incorporated herein by reference in their entireties), they can be attached to the universal public-space fixture 100 relative to different pairs of legs 14, and they can be associated singly with the universal public-space fixture 100, as shown in FIGS. 24A-24B, 25A-25B, 26A-26C, and 27A-27C, rather than together (that is, an ash urn 80*a* alone can be associated with the universal public-space fixture 100, as shown in FIGS. 26A-26C and FIGS. 27A-27C, as can the trash can receptacle 80*b*, as shown in FIGS. 24A-24B and 26A-26B).

It is contemplated that the universal public-space fixture 10, 10', 100, 100', and 1000 in accordance with the present invention can be combined with multiple types of public space fixtures, to provide a multi-function public-space system. For example, two or more universal public-space fixtures fixture 10, 10', 100, 100', and 1000 can be used to support both seating and litter control fixtures, such as the benches 40 and 52 and ash urn 80*a* and trash can receptacle 80*b* as shown in FIGS. 28A-28D; and two or more spaced universal public-space fixtures fixture 10, 10', 100, 100', and 1000 can be used to support both seating and signage fixtures, such as the bench 50 and sign 90 as shown in the embodiment of FIGS. 29A-29D, which are respectively attached to the universal public-space fixtures 100 by brackets 44 and brackets 92.

As can be appreciated from the foregoing, the esthetic requirement for public-space fixtures is well-served by the universal public-space fixture in accordance with the invention, as opposed to conventional concrete or other protective fixtures. The system of the universal public-space fixture and associated site amenities is also extremely cost effective in that for little more than the cost of the amenities themselves, the added element of security can be addressed. The universal public-space fixture alone or the system can be installed with relatively common and available materials and equipment at relatively low cost.

Modifications and variations of the above-described embodiments of the present invention are possible, as appreciated by those skilled in the art in light of the above teachings. For example, as shown in FIGS. 32A-32D with respect to a seventh embodiment 110" of a universal public-space fixture, the upper transverse portion 12" of the substantially U-shaped forms can be asymmetrically inclined, rather than symmetric about the axis A. It is therefore to be understood that, within the scope of the appended claims and their equivalents, the invention may be practiced otherwise than as specifically described.

What is claimed is:

1. A bollard comprising:

a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction, wherein each substantially U-shaped form has an upper transverse portion and two parallel, vertical legs extending from the upper transverse portion; and means for joining the substantially U-shaped forms together as a unit, wherein the means for joining comprises at least one center joining plate located below the upper transverse portions of the forms, the forms being fastened to the at least one center joining plate, wherein the center joining plate comprises a disc having notches at the perimeter thereof complimentary in shape to the cross-section of the legs for engaging the substantially U-shaped forms.

2. The bollard of claim 1 wherein the forms are substantially vertical and the at least one center joining plate is substantially horizontal.

3. The bollard of claim 1 wherein the at least one center joining plate is substantially perpendicular to the forms.

4. A bollard comprising:

a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction, wherein each substantially U-shaped form has an upper transverse portion and two parallel, vertical legs extending from the upper transverse portion; and means for joining the substantially U-shaped forms together as a unit, wherein the means for joining comprises at least one center joining plate located below the upper transverse portions of the forms, the forms being fastened to the at least one center joining plate, wherein the center joining plate comprises a spider having radiating arms that engage the substantially U-shaped forms.

5. The bollard of claim 1, further comprising means for anchoring the forms to a support surface.

6. The bollard of claim 5, wherein the means for anchoring comprises a plate attached to the forms in the vicinity of their bottom.

7. The bollard of claim 1, comprising three substantially U-shaped forms.

8. A public-space system comprising at least one bollard and at least one site amenity, wherein:

the bollard comprises a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction;

the at least one site amenity is associated with the at least one bollard; and the at least one site amenity comprises lighting.

9. The public-space system of claim 8, further comprising means for attaching the at least one site amenity to the at least one bollard.

10. The public-space system of claim 8, wherein the at least one site amenity further comprises seating.

11. The public-space fixture of claim 10, further comprising means for attaching the seating to the at least one bollard.

12. The public-space fixture of claim 10, further comprising means for supporting the seating in close proximity to the at least one bollard.

13. The public-space fixture of claim 8, further comprising means for attaching the lighting to the at least one bollard.

14. A public-space system comprising at least one bollard and at least one site amenity, wherein:

the bollard comprises a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction;

the at least one site amenity is associated with the at least one bollard; and the at least one site amenity comprises a canopy and means for attaching the canopy to the at least one bollard.

15. A public-space system comprising at least one bollard and at least one site amenity, wherein:

the bollard comprises a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction;

the at least one site amenity is associated with the at least one bollard; and the at least one site amenity comprises a trash can receptacle.

16. The public-space fixture of claim 15, further comprising means for attaching the trash can receptacle to the at least one bollard.

17. A public-space system comprising at least one bollard and at least one site amenity, wherein:

the bollard comprises a series of at least two nested, inverted, substantially U-shaped forms of decreasing height set around a common vertical axis, the U-shaped forms being made of metal pipes, and wherein the U-shaped forms have physical characteristics such that on impact by a moving vehicle, including an automobile or a truck, the U-shaped forms will initiate a "crumple zone" type reaction;

the at least one site amenity is associated with the at least one bollard; and the at least one site amenity comprises an ash urn.

18. The public-space system of claim 17, further comprising means for attaching the ash urn to the at least one bollard.

19. The public-space system of claim 8, comprising at least two bollards linked together by the at least one site amenity, whereby the system has different behavior and strength characteristics than a single bollard.

20. The bollard of claim 1, wherein each substantially U-shaped form has an upper transverse portion and two parallel, vertical legs extending from the upper transverse portion, and wherein the U-shaped forms further have physical characteristics such that the energy of the impact will deform the bollard significantly, with the horizontal energy of the impact being deflected in a series of distortions that are both vertical and horizontal, with most of the horizontal energy being deflected in the vertical legs.

21. The public-space system of claim 14, wherein each substantially U-shaped form has an upper transverse portion and two parallel, vertical legs extending from the upper transverse portion, and wherein the U-shaped forms further have physical characteristics such that the energy of the impact will deform the bollard significantly, with the horizontal energy of the impact being deflected in a series of distortions that are both vertical and horizontal, with most of the horizontal energy being deflected in the vertical legs.

* * * * *